US007909319B2

(12) United States Patent
Shibagaki et al.

(10) Patent No.: US 7,909,319 B2
(45) Date of Patent: Mar. 22, 2011

(54) IMAGE FORMING APPARATUS AND IMAGE FORMING METHOD

(75) Inventors: Yasutaka Shibagaki, Matsumoto (JP); Satoshi Noda, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 131 days.

(21) Appl. No.: 11/840,836

(22) Filed: Aug. 17, 2007

(65) Prior Publication Data

US 2008/0217846 A1 Sep. 11, 2008

(30) Foreign Application Priority Data

Aug. 17, 2006 (JP) ..... 2006-222644
Jul. 26, 2007 (JP) ..... 2007-194403

(51) Int. Cl.
*B65H 5/00* (2006.01)

(52) U.S. Cl. ..... 271/10.02; 271/4.02; 271/10.01

(58) Field of Classification Search ..... 271/10.02, 271/10.01, 4.02, 4.01
See application file for complete search history.

(56) References Cited

U.S. PATENT DOCUMENTS

| | | | | |
|---|---|---|---|---|
| 3,737,158 | A * | 6/1973 | Beery et al. | 271/10.03 |
| 2006/0039019 | A1* | 2/2006 | Okamoto | 358/1.12 |
| 2006/0071416 | A1* | 4/2006 | Mizuno | 271/258.01 |

FOREIGN PATENT DOCUMENTS

| | | |
|---|---|---|
| JP | 07-196208 | 8/1995 |
| JP | 2001-253572 | 9/2001 |
| JP | 2003-104578 | 4/2003 |
| JP | 2005-231845 | 9/2005 |
| JP | 2006-089221 | 4/2006 |

* cited by examiner

*Primary Examiner* — Stefanos Karmis
*Assistant Examiner* — Ernesto Suarez
(74) *Attorney, Agent, or Firm* — Workman Nydegger

(57) ABSTRACT

To provide an image forming apparatus and image forming method that can prevent a decrease in image quality by preventing a step-out of a driving source, which occurs because a load of a feeding device is applied when a medium is transported for image formation.

When no roller reset operation, by which a paper feed roller is returned to a reset position, is performed (YES in S21), it is judged whether a counted value N of a counter, which indicates a position of a sheet of paper, is below a threshold value Na, which indicates that it is in an A region in which a load of a hopper or paper return levers of an automatic sheet feeder (ASF) is applied to a stepping motor (S22). When N<Na, driving for high torque is selected (S23), and then paper transport in the A region is performed with a high torque (S25). On the other hand, when N≧Na, driving for low torque is selected (S24) and then paper transport in a B region after the A region has passed is performed with a low torque (S25). When the position of a sheet of paper passes a boundary between the A region and the B region, paper transport is performed with a high torque.

4 Claims, 9 Drawing Sheets

IMAGE FORMING APPARATUS AND IMAGE FORMING METHOD

BACKGROUND OF THE INVENTION

1. Field of the Invention

The present invention relates to an image forming apparatus and image forming method that feeds and transports a medium while recording an image, or the like, on the medium being transported.

2. Description of the Related Art

Conventionally, some printers, which are one of image forming apparatuses, are provided with an automatic sheet feeder (hereinafter, referred to as ASF (Auto Sheet Feeder)), which are, for example, disclosed in Patent Document 1, Patent Document 2, and the like. A sheet of paper set on the ASF, when print is going to be initiated, is automatically fed to a print start position by driving the ASF, thus setting a leading end position.

The ASF includes a paper feed guide, a hopper, and a paper feed roller. Multiple sheets of paper may be mounted on the paper feed guide. The hopper is tiltable so as to push out the sheets of paper, which are stacked on the paper feed guide. The paper feed roller is arranged in proximity to the lower end of the hopper so as to be opposed to the hopper. The paper feed roller is driven by the same driving source that drives a paper transport roller and a paper discharge roller. As the paper feed roller is driven by the driving source to rotate one revolution while its circular arc surface is in contact with an uppermost sheet of paper among the sheets of paper stacked on the hopper, the uppermost sheet of paper P is fed to the paper transport roller. In addition, paper return levers are provided in a paper feed opening that is formed between the paper feed roller and the hopper. The paper return levers are tilted to a rest position to ensure a paper feed opening for a sheet of paper when paper feeding is initiated, and, when the paper feeding of the uppermost sheet of paper is finished, the paper return levers are tilted up from the rest position and pivotally returned so that the following sheets of paper, the distal ends of which enter a transport path below the paper feed roller, are pushed back onto the hopper Conventionally, there has been a case where a stepping motor is used as the same driving source (paper transport motor) for both the paper transport roller and the paper feed roller.

[Patent Document 1] Japanese Unexamined Patent Application Publication No. 2003-104578

[Patent Document 2] Japanese Unexamined Patent Application Publication No. 2006-89221

Incidentally, the stepping motor is driven in a paper feed mode during paper feeding, while the stepping motor is driven in a driving mode, called paper transport mode, for transporting a sheet of paper while printing after the paper feeding. However, there has been a case where, when a sheet of paper is fed to a leading end setting position, the paper feed roller has not completed a roller reset operation, by which the paper feed roller is returned to an original reset position, and the hopper and the paper return levers are still performing a return operation. In this case, the paper feed roller gradually pivots every time the printing sheet of paper is transported to thereby progress the reset operation; however, at this time, the hopper is also pushed into the rest position against the urging force of a spring and, in addition, an operation to raise the paper return levers is also performed. Therefore, a load generated for the reset operation accompanied by these return operations has also been applied to the stepping motor.

When paper transport is driven in a normal paper transport mode in a state where a large load resulting from the return operation of the hopper or a large load for returning the paper return levers is applied, there has been a case where a step-out of the stepping motor occurs. That is, there has been a problem that a desired amount of paper transport cannot be performed because of the step-out of the stepping motor during paper transport driving or a phenomenon occurs in which a fed sheet of paper is pulled back in a counter paper transport direction due to the step-out during a stop between adjacent paper transport operations and, thereby, deviated from an appropriate position.

Thus, because a load resulting from the above return operation is generated depending on a leading end setting position of a sheet of paper, in order to bypass the above problem, it has been necessary to uniformly set a high torque for paper transport driving in conformity with a maximum load. In this case, a step-out of the stepping motor may be solved; however, because the stepping motor is driven with a high torque even in a paper transport region after the reset operation, where the high torque is originally not required, there have been a problem that the stepping motor heats up more than necessary in order to apply a redundant electric current and/or a problem that drive noises increase and thereby a noise of the printer while printing increases.

The invention is contemplated to solve the above described problems and its object is to provide an image forming apparatus and image forming method that can prevent a decrease in image quality by preventing a step-out of a driving source, which occurs because a load of a feeding device is applied when a medium is transported for image formation.

SUMMARY OF THE INVENTION

According to a gist of the invention, it includes a feeding device that feeds a medium, a transport device that transports the medium fed by the feeding device, a recording means that forms an image on the medium transported by the transport device, a step drive driving source that drives both the feeding device and the transport device, a judging means that judges whether it is in a loading period during which a load resulting from an operation of the feeding device is applied to the driving source, and a control means that sets a torque of the driving source, when the transport device transports the medium for which recording is performed by the recording means, higher than a setting torque of the driving source in a period after the loading period has passed, wherein the control means makes the driving source be driven with the same torque as the torque in the loading period when a transport operation is performed to pass a boundary between the loading period and the period after the loading period has passed.

Note that it is not always necessary to normally set the torque higher than the setting torque over the entire period within the loading period; the torque may be set higher than the setting torque only in a period of driving speed, during which a step-out particularly tends to occur, within the loading period (including stop period). For example, a high torque may be set in the entire or only part of an acceleration region of the transport operation, a high torque may be set in the entire or only part of a constant speed region, a high torque may be set in the entire or only part of a deceleration region, or a high torque may be set in a region that combines two or more of these regions. Moreover, when a transport operation is performed in an intermittent manner, it is applicable that only a stop torque applied in a stop period between the adjacent transport operations is set to a high torque.

According to this, the control means, in a loading period during which a load for operation of the feeding device is applied to the driving source, sets a torque higher than a setting torque of the driving source, which is set for a period after the loading period has passed, and controls a torque of the driving source when the transport device transports a medium for which recording is performed by the recording means. Thus, when the medium is transported in the loading period, it is possible to suppress the occurrence of a step-out of the driving source. At this time, when the transport operation is performed to pass the boundary between the loading period and the period after the loading period has passed, the driving source is driven with the same high torque as the torque in the loading period. Thus, even in the transport operation that is performed to pass the boundary, it is possible to suppress the occurrence of a step-out of the driving source. Accordingly, it is possible to prevent a decrease in recording quality, which is caused by the recording position of an image being deviated in the transport direction with respect to the medium due to a step-out of the driving source.

In addition, it is preferable that the image forming apparatus according to the invention further includes a position detection means that detects a transporting position of the medium, wherein the control means judges whether it is in the loading period by judging whether the transporting position of the medium, which is detected by the position detection means, falls within a region in which a load resulting from a predetermined operation of the feeding device is applied to the driving source, and wherein the control means, when the transporting position of the medium, which is detected by the position detection means, falls within the region, sets a torque of the driving source higher than a setting torque of the driving source for a transporting position that has passed the region.

According to this, the control means, when the transporting position of the medium, which is detected by the position detection means, falls within the region in which a load for operation of the feeding device is applied to the driving source, sets a torque higher than a setting torque of the driving source, which is set for a region after the above region, in which the load is applied, has passed. Thus, when the medium is transported when the transporting position is located within the region, it is possible to suppress the occurrence of a step-out of the driving source. Accordingly, it is possible to prevent a decrease in recording quality caused by the recording position of an image being deviated in the transport direction with respect to the medium due to a step-out of the driving source.

Furthermore, it is preferable that the image forming apparatus according to the invention further includes a recording mode setting means that sets a recording mode, wherein a torque to be set for the driving source in the loading period is a first torque, and a torque to be set for the driving source in the period after the loading period has passed is a second torque, wherein the control means (1) when in a first recording mode, executes a first feed sequence in which the medium is set to a leading end setting position with a feeding operation only in the transport direction, and controls switching between the first torque and the second torque on the basis of the loading period, and (2) when in a second recording mode, executes a second feed sequence after the medium is once fed in the transport direction to a position at which the loading period of the feeding device ends, performs reverse feeding by which the medium is returned in a counter transport direction, and then sets the medium to a leading end setting position by the feeding operation being performed in the transport direction again, and the control means controls the driving source with the second torque irrespective of a period during which a load is applied to the driving source.

According to this, when the first recording mode is set by the recording mode setting means, the first feed sequence is executed to set the medium to a leading end setting position with the feeding operation only in the transport direction, and the control is performed to switch between the first torque and the second torque on the basis of the loading period. On the other hand, when the second recording mode is set, the second feed sequence is executed in such a manner that, after the medium is once fed in the transport direction until the loading period of the feeding device ends, a reverse feeding is performed to return the medium in the counter transport direction, and then the medium is set to a leading end setting position with the feeding operation in the transport direction again, and the driving source may be controlled with the second torque irrespective of a period during which the load is applied to the driving source.

Moreover, in the image forming apparatus according to the invention, it is preferable that the feeding device includes a feed roller and a movable portion that moves from a waiting position to a feedable position in cooperation with initiation of the feed roller when feeding is started and that returns to the waiting position when feeding is completed, wherein the loading period is a period during which a return operation of the movable portion to the waiting position is performed.

According to this, the movable portion moves from the waiting position to the feedable position in cooperation with initiation of the feed roller when feeding is started and returns to the waiting position when feeding is completed. A period during which this movable portion returns to the waiting position is used as the loading period, and the driving source is controlled with the first torque.

In addition, it is preferable that the image forming apparatus according to the invention further includes a storage means that stores a low torque table and a high torque table that are selected to control a torque of the driving source when the control means makes the transport device perform the transport operation and that are in correspondence with a speed table of the driving source, wherein the control means selects the high torque table within the loading period and selects the low torque table after the loading period has passed, wherein the high torque table is set so that, when the feed roller of the feeding device initiates to feed the medium, a torque in a period during which a load resistance is received from the medium is set higher than a torque in the other period during feeding.

According to this, during the loading period, the driving source is controlled with a high torque in accordance with the high torque table, and, after the loading period has passed, the driving source is controlled with a low torque in accordance with the low torque table. Furthermore, the high torque table is set so that, when the feed roller of the feeding device initiates to feed the medium, a torque in a period, during which a load resistance is received from the medium, is set higher than a torque in the other period during feeding. Thus, although a relatively large load resistance is received from a medium when the feed roller of the feeding device initiates to feed the medium, because the driving source is driven with a torque larger than a torque in the other period during feeding in this period, it is possible to smoothly feed the medium when the feed roller initiates to feed the medium.

Moreover, in the image forming apparatus according to the invention, it is preferable that the control means sets a stop torque of the driving source during a stop period between the adjacent transport operations higher in the loading period than in the period after the loading period has passed.

According to this, the stop torque of the driving source during a stop period between the adjacent transport operations is set higher in the loading period than in the period after the loading period has passed. Therefore, even in the loading period, it is possible to improve the accuracy of stop position of the medium during a stop between the adjacent transport operations.

Moreover, a gist of the invention provides an image forming method used for an image forming apparatus including a feeding device that feeds a medium, a transport device that transports the medium fed by the feeding device, a recording means that forms an image on the medium transported by the transport device, and a common step drive driving source that drives both the feeding device and the transport device. The method includes a judging step in which it is judged whether it is in a loading period during which a load resulting from an operation of the feeding device is applied to the driving source, and a controlling step in which, in the loading period, a torque of the driving source, when the transport device transports a medium for which recording is performed by the recording means, is set higher than a setting torque of the driving source in a period after the loading period has passed, wherein, in the controlling step, when a transport operation is performed to pass a boundary between the loading period and the period after the loading period has passed, the driving source is driven with the same torque as the torque in the loading period.

According to this, it is possible to prevent a decrease in recording quality by preventing a step-out of the driving source that occurs when a load resulting from an operation of the feeding device is applied to the driving source.

BRIEF SUMMARY OF THE DRAWINGS

FIG. 5 is a partial plan view of a sheet of paper, illustrating a paper transport operation by which a boundary between an A region and a B region is passed through.

FIG. 10(*b*) is a timing chart that shows a second paper feed sequence and the paper transport sequence.

DESCRIPTION OF THE REFERENCE NUMERALS

Figure 1:
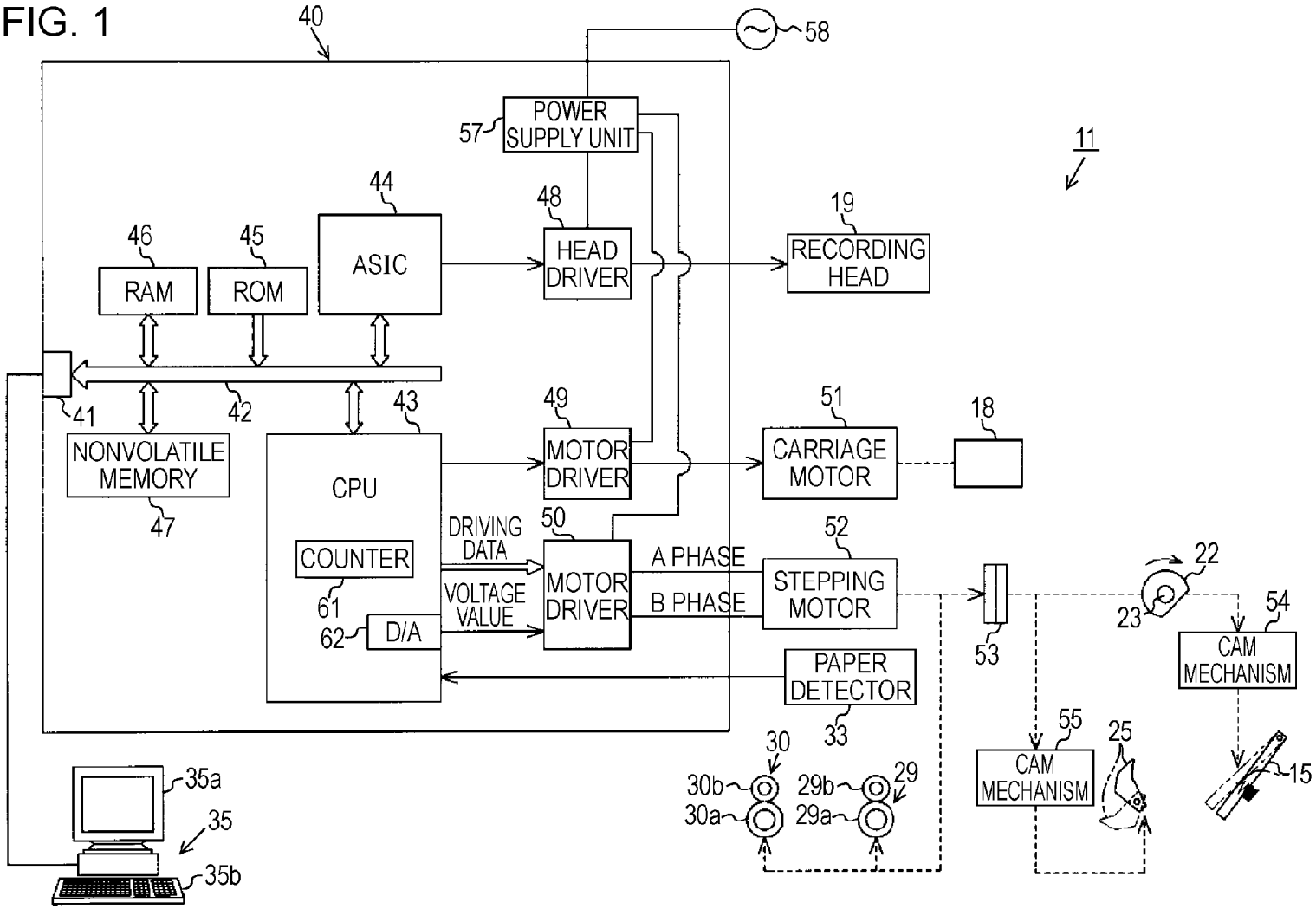
FIG. 1 is a block diagram that shows an electrical configuration of a printer according to one embodiment.

11: printer as an image forming apparatus, 13: automatic sheet feeder (ASF) as a feeding device, 15: hopper as a movable unit, 18: carriage that constitutes a recording means, 19: recording head that constitutes a recording means, 21: compression spring, 22: paper feed roller, 24: retard roller, 25: paper return levers as a movable unit, 29: paper transport rollers that constitute a transport device, 30: paper discharge rollers, 33: paper detector that constitutes a position detection means, 35: host computer, 40: control unit, 43: CPU that constitutes a control means, a judgment means and a determination means, 45: ROM as a storage means, 50: motor driver that constitutes the control means, 52 stepping motor as a step drive driving source, 53: clutch, 54: cam mechanism, 55: cam mechanism, 61: counter that constitutes the position detection means, VT1: low torque voltage value table as a low torque table, VT2 high torque voltage value table as a high torque table, T: acceleration table as a speed table, N: counted value that indicates a transporting position, Na: threshold value of A region, P, P1: sheet of paper as a medium

DETAILED DESCRIPTION OF THE PREFERRED EMBODIMENTS

One embodiment in which the invention is applied to a serial printer will now be described with reference to FIG. 1 to FIG. 10. FIG. 3 is a perspective view of the serial printer according to the present embodiment. The serial printer (hereinafter, simply referred to as printer 11), which serves as an image forming apparatus, is, for example, an ink jet printer. The printer 11 is provided at the rear side of a main body 12 with an automatic sheet feeder (Auto Sheet Feeder; hereinafter, referred to as ASF 13), which serves as a feeding device, that feeds a sheet of paper P, which serves as a medium. A paper guide 17 includes a paper feed tray 14, a hopper 15, which serves as a movable unit, an edge guide 16 and a paper support 14*a*, and is attached to the ASF 13. The ASF 13 has a paper feed driving mechanism that feeds sheets of paper set on the paper guide 17 into the main body 12 sheet by sheet. A carriage 18 is provided in the main body 12. The carriage 18 reciprocates in a main scanning direction (in an X direction in FIG. 3). A recording head 19 is provided on the lower side of the carriage 18. Printing is performed on the sheet of paper P by alternating a recording operation by which ink is ejected from the recording head 19 to the sheet of paper P in a process in which the carriage 18 is moved in the main scanning direction X and a paper transport operation by which the sheet of paper P is transported in an auxiliary scanning direction Y by a predetermined amount of transport. The printed sheet of paper P will be discharged through a paper discharge opening 12A that opens at the front lower side of the main body 12, Note that the carriage 18 and the recording head 19 constitute a recording means.

Figure 2:
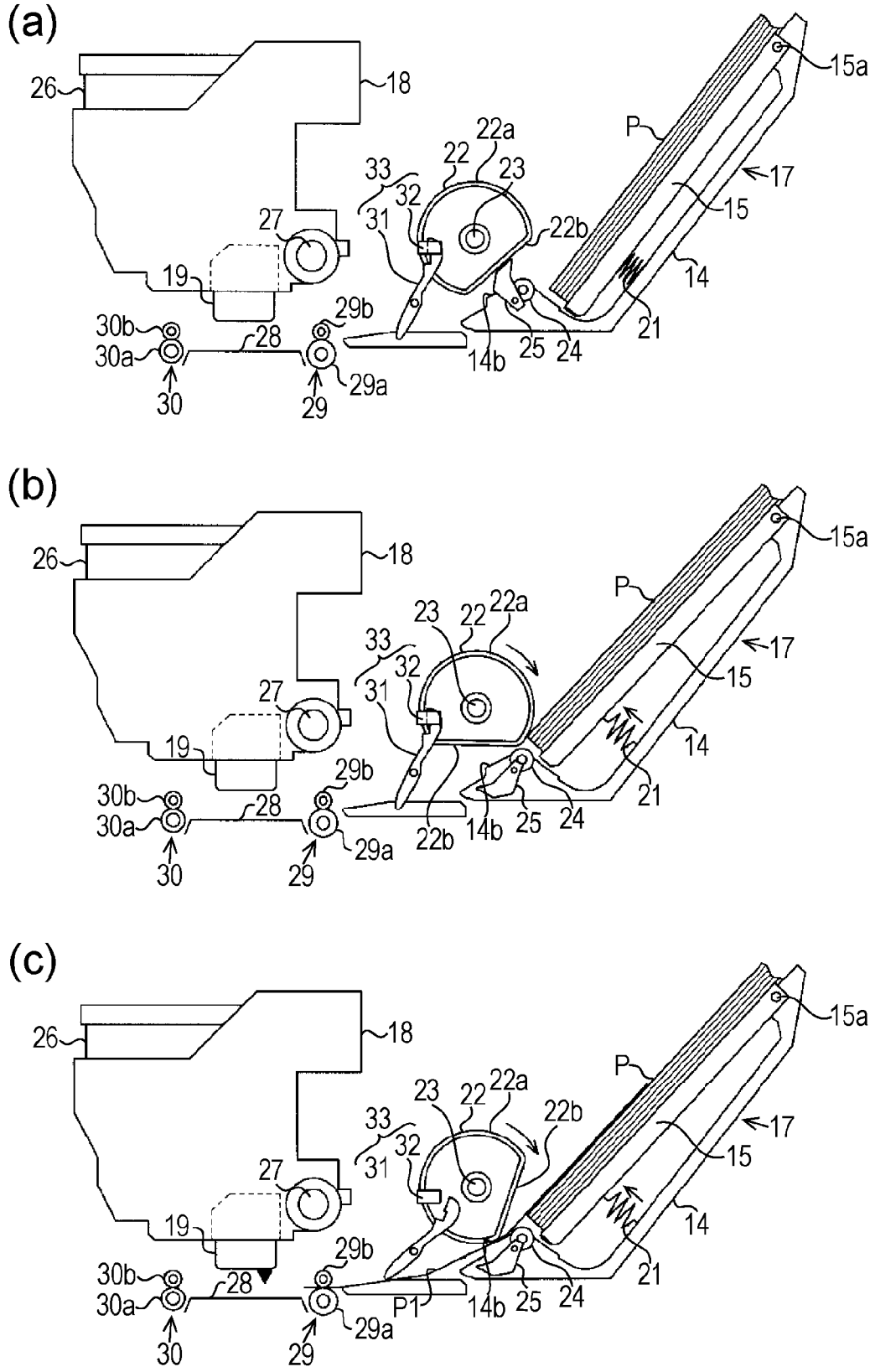
FIG. 2(*a*) to FIG. 2(*c*) are schematic side views that illustrate an operation of an automatic sheet feeder.
Figure 3:
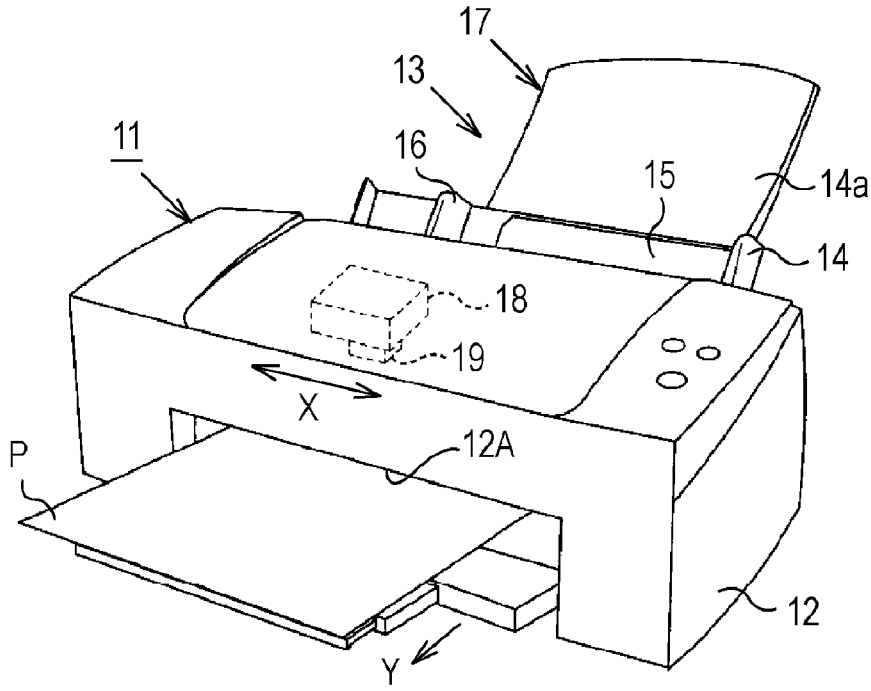
FIG. 3 is a perspective view of the printer.

FIG. 2 shows an automatic sheet feeder. FIG. 2(*a*) shows a reset state before paper feeding is started. FIG. 2(*b*) shows a state of being at a paper feeding start position. FIG. 3(*c*) shows a state of being at a paper feeding end position. As shown in FIG. 2, the hopper 15 is supported on the upper surface side of the paper feed tray 14 that is arranged obliquely on the rear side of the main body about a shaft 15*a* provided at the upper end portion so as to be tiltable within a predetermined range of angle. The hopper 15 is urged in a direction away from the paper feed tray 14 (in a direction to the upper left side in FIG. 2) by a compression spring 21 that is provided between the hopper 15 and the paper feed tray 14.

A paper feed roller 22 (LD roller) is arranged near the lower end of the hopper 15 so as to be rotatable about a rotary shaft 23. The paper feed roller 22 has a substantially D-shape in side view. The outer peripheral surface of the paper feed roller 22 is formed of a circular arc surface 22*a* that is constant in distance from its axis and a flat surface 22*b* that is shorter in distance from the axis. The paper feed roller 22 performs a paper feeding operation as the flat surface 22*b* returns from a reset position in which the flat surface 22*b* is opposed to the hopper 15 as shown in FIG. 2(*a*) to the reset position again by rotating one revolution in a direction indicated by an arrow in FIG. 2(*b*). The surface of the paper feed roller 22 is formed to be a high frictional resistance surface.

The hopper 15 is coupled to the paper feed roller 22 through a cam mechanism 54 (see FIG. 1). The hopper 15 reciprocates once between a rest position shown in FIG. 2(*a*) and a paper feed position shown in FIG. 2(*b*) at a predetermined timing in cooperation with rotation of the paper feed roller 22.

A guide portion 14*b* is provided on the upper surface of the downstream end (left side in FIG. 2) of the paper feed tray 14. In addition, a retard roller 24 is arranged at a position in proximity to the upper end of the guide portion 14*b* and opposite the paper feed roller 22. The retard roller 24 is pivoted rotatably in a state where a constant rotational load is applied to the retard roller 24 by a torque limiting mechanism, such as a torque limiter.

A plurality of paper return levers 25 are pivoted swingably about a shaft of their proximal end side and provided at substantially equal intervals in the widthwise direction of a sheet of paper P (a direction perpendicular to the sheet of FIG. 2). The paper return levers 25, through a cam mechanism 55 (see FIG. 1), reciprocate once between an upright position shown in FIG. 2(*a*) and a rest position shown in FIG. 2(*b*) at a predetermined timing in cooperation with rotation of the paper feed roller 22 in an initial process of paper feeding.

The carriage 18 that is loaded with an ink cartridge 26 is provided at a position downstream in a paper transport direction than the ASF 13 so as to be movable in the main scanning direction (the direction perpendicular to the sheet face of FIG. 2) along a guide shaft 27. A platen 28 is arranged below the recording head 19 with a predetermined space formed therebetween. Paper transport rollers 29 and paper discharge rollers 30 are respectively arranged at both sides of the platen 28 in the auxiliary scanning direction (the left to right direction of the drawing).

The paper transport rollers 29 are formed of a pair of transport drive roller 29*a* and transport driven roller 29*b*. The paper discharge rollers 30 are also formed of a pair of paper discharge drive roller 30*a* and paper discharge driven roller 30*b*. In the present embodiment, the paper feed roller 22, the transport drive roller 29*a* and the paper discharge drive roller 30*a* are driven by the same driving source, a stepping motor 52 (paper transport motor) (see FIG. 1), and cooperate to perform feeding, transporting and discharging of a sheet of paper P. However, the paper feed roller 22 is configured so that a power transmitting path of the stepping motor 52, which is a driving source, is disconnectable and the power transmitting path is switched to a connected state in which power can be transmitted only during paper feeding. Note that it is sufficient when the paper feed roller 22 and the paper transport rollers 29 are driven by the same driving source. For example, the paper discharge rollers 30 may be driven by another driving source.

A paper detector 33, which is formed of a lever 31 and an optical sensor 32, is provided between the paper feed roller 22 and the paper transport rollers 29. The lower end of the lever 31 is elongated to reach the paper transport path. The optical sensor 32 is to detect the upper end portion of the lever 31. The paper detector 33, when no sheet of paper P1 presses the lower end of the lever 31, is turned off in such a manner that the lever 31 is returned to an original position, as shown in FIG. 2(*a*) and FIG. 2(*b*), by the urging force of a spring. The paper detector 33, when the sheet of paper P1 presses the lower end of the lever 31 in the midway of paper feeding to pivot it, as shown in FIG. 2(*c*), is turned on. Specifically, the sensor 32 of the paper detector 33 includes a light emitter and a light receiver. When the lever 31, which blocks light projected from the light emitter, is pivoted by being pressed by the sheet of paper P1, and the light receiver then receives the projected light, so that the paper detector 33 is turned on.

In advance of paper feeding, a clutch 53 (see FIG. 1) that is provided in the power transmitting path of the stepping motor 52 is connected in such a manner that the carriage 18 moves to one end position in the moving path to press a clutch lever (trigger lever) (not shown). Thus, it enters a state where power of the stepping motor 52 is transmittable to the paper feed roller 22, the hopper 15 and the paper return levers 25. When in a roller reset state in which the paper feed roller 22 is arranged at a reset position as shown in FIG. 2(*a*), the hopper 15 is arranged at a rest position, and the paper return levers 25 are arranged at an upright position. When the stepping motor 52 is driven in forward rotation in a state where the clutch 53 is connected, the paper feed roller 22 initiates to rotate. In accordance with this, the hopper 15 is moved through the cam mechanism 54 in the direction urged by the compression spring 21 and then arranged at a paper feed position, while the paper return levers 25 are tilted from the upright position to the rest position through the cam mechanism 55, thus ensuring a paper feed opening for a sheet of paper P. At the timing immediately after this, the leading end of the circular arc surface 22*a* of the paper feed roller 22 abuts against the sheet of paper P on the hopper 15 (see FIG. 2(*b*)).

Among the sheets of paper P that are urged by the circular arc surface 22*a* of the paper feed roller 22 owing to the hopper 15, the uppermost one sheet is pinched between the paper feed roller 22 and the retard roller 24 and fed by the rotation of the paper feed roller 22. In this paper feeding process, among the sheets of paper P that are urged by the paper feed roller 22, only the uppermost one sheet is separated from the other sheets of paper and then fed owing to a balance among the rotational resistance of the retard roller 24, the frictional resistance of the peripheral surface of the paper feed roller 22 and the frictional resistance of the surface of the sheets of paper P.

Here, the length of the circular arc surface 22*a* of the paper feed roller 22 in the circumferential direction is substantially equal to the length in the transmitting path from the distal end (lower end) of the sheets of paper P, stacked on the hopper 15, to the nipping point of the paper transport rollers 29. The fed sheet of paper P1 is nipped by the paper transport rollers 29, at substantially the same time the terminal end of the circular arc surface 22*a* of the paper feed roller 22 is separated from the sheet of paper P1. Thus, a back tension does not act on the sheet of paper P1 that is transported by the paper transport rollers 29.

After the terminal end of the circular arc surface 22*a* is separated from the sheet of paper P1, the hopper 15 is moved from the paper feeding position as shown in FIG. 2(*c*) in a direction indicated by an arrow in the drawing against the urging force of the compression spring 21 through the cam mechanism 54 and then returned to the rest position as shown in FIG. 2(*a*). Slightly after this return operation of the hopper 15, the paper return levers 25 are pivoted from the rest position, as shown in FIG. 2(*c*), in a direction indicated by an arrow in the drawing through the cam mechanism 55 and then raised to the upright position, as shown in FIG. 2(*a*). Owing to this raising operation of the paper return levers 25, the following other sheets of paper P, the distal ends of which enter a gap in the paper feed opening are pushed back onto the paper feed tray 14. Immediately after this, when the paper feed roller 22 completes one revolution to return to the reset position, the connected clutch 53 is disconnected. The fed sheet of paper P1 passes between the paper transport rollers 29 and the leading end thereof is set to a recording start position between the carriage 18 and the platen 28. For the recording start position on the sheet of paper, the position of nozzles that are located on the most upstream side in the transport direction among group of nozzles that open at the lower face of the recording head is a reference position (a position indicated by a solid inverted triangle shown in FIG. 2(*c*)), and the leading end is set in such a manner that the print start position on the sheet of paper is made accordant with this reference position.

The leading end setting position varies in response to a layout condition, such as a margin (top margin) or zero margin printing, that determines a print start position on a sheet of paper. When the margin is set to zero or the top margin is set small, and a leading end position is set adjacent to the distal end of a sheet of paper, the hopper 15 and the paper return levers 25 complete paper feeding in the midway they are returning. In this case, after the paper feeding of the sheet of paper P1 is completed (that is, after setting the leading end position) in a process of the paper transport operation that is performed alternately with the printing operation of the recording head 19, the hopper 15 and the paper return levers 25 progress their return operation, and the roller reset operation is performed to return the paper feed roller 22 to the reset position. The return operation of the hopper 15 is an operation by which the hopper 15 is tilted to the rest position against the urging force of the compression spring 21. The return operation of the paper return levers 25 is an operation by which the paper return levers 25, when pivoted to the upright position, are pivoted against the urging force of a spring (not shown). Thus, a load (urging force) resulting from the urging force of the compression spring 21 and the urging force of the spring is applied to the stepping motor 52 during paper transport operation through the cam mechanisms 54, 55.

An electrical configuration of the printer that is provided with the automatic sheet feeder will now be described with reference to FIG. 1. As shown in FIG. 1, the printer 11 includes a control unit 40 that governs various controls. The control unit 40 includes an interface 41 that is connected communicable with a host computer 35 (PC). A CPU 43, an ASIC 44, a ROM 45, a RAM 46 and a nonvolatile memory 47, and the like, are connected to a bus 42 that is connected to the interface 41. The CPU 43 performs a paper feed control, a paper transport control, a printing control, or the like, by executing a program stored in the ROM 45. The ASIC 44 executes an image processing by which input print data are converted to bitmap data of predetermined gray-scale values that become discharge signals for discharging ink droplets from the nozzles of the recording head 19.

A head driver 48 is connected to the ASIC 44. The ASIC 44 controls the recording head 19 through the head driver 48 to discharge ink droplets from the nozzles. In addition, motor drivers 49, 50 are connected to the CPU 43. The CPU 43 controls driving of a carriage motor 51 through the motor driver 49 and controls driving of the stepping motor 52 (paper transport motor) through the motor driver 50. Note that the motor driver 50 and the stepping motor 52 cooperate to form a paper transport means. Furthermore, various commands are attached to the header of the print data. The CPU 43 interprets the commands and thereby acquires the amount of paper transport by which the stepping motor 52 transports a sheet of paper during paper feeding or paper transport.

In addition, the output shaft of the stepping motor 52 is coupled through a wheel work (not shown) to the transport drive roller 29*a* and the paper discharge drive roller 30*a* so that it can transmit power. Furthermore, the output shaft of the clutch 53 that uses the end portion of the rotary shaft of the transport drive roller 29*a* as an input shaft, for example, is coupled to the rotary shaft 23 of the paper feed roller 22. The clutch 53 is, for example, configured to be mechanically connected when the carriage 18 is moved to a paper feed waiting position that is opposite to a home position to thereby push the clutch lever. Note that the paper transport rollers 29, the wheel work, and the like, cooperate to form a transport device.

When the clutch 53 is connected, the rotation of the stepping motor 52 becomes transmittable to the paper feed roller 22. The rotary shaft 23 of the paper feed roller 22 is coupled through the cam mechanism 54 to the hopper 15, while the output shaft of the clutch 53 is coupled through the cam mechanism 55 to the paper return levers 25.

A power supply unit 57 is provided in the control unit 40. The power supply unit 57 converts alternating current of a predetermined voltage that is taken from an alternating current power supply 58 to a direct current of a predetermined voltage by voltage transformation/rectification. The power supply unit 57 supplies driving voltages suitable for the head driver 48 and the motor drivers 49, 50 (for example, approximately 10 V and approximately 40 V), and supplies a predetermined voltage suitable for the CPU 43, the ASIC 44, and the like (for example, approximately 3 V).

The CPU 43 internally includes a counter 61 that counts the number of steps of the stepping motor 52. The counter 61, when the paper detector 33 is turned on, is reset by the CPU 43. Thus, a counted value N corresponds to a distance on the paper transport path from the detecting position of the paper detector 33 to the distal end of the sheet of paper P1, and is counted by the counter 61. The CPU 43 acquires a position of the sheet of paper P after the leading end setting (transporting position) through the counted value N of the counter 61.

In addition, the CPU 43 includes a D/A converter 62 (D/A port). The CPU 43 transmits driving data to the motor driver 50 for driving the stepping motor 52 and instructs a voltage value from the D/A converter 62 in synchronization with the driving data. The driving data include data to be instructed, such as rotational direction or frequency (furthermore, excitation mode). The motor driver 50 applies two types (A phase, B phase) of current pulse that are different in phase, having current values corresponding to the instructed voltage values, and that exhibit a rotational direction and frequency on the basis of the driving data, to exciting coils of the respective phases of the stepping motor 52. Note that the stepping motor 52 employs, for example, a two-phase excitation mode; however, the stepping motor 52 may also employ a one-phase excitation mode, a one-phase/two-phase excitation mode, a micro step driving (vernier driving) mode. Furthermore, a rotor may employ any one of a permanent magnet type (PM type), a gear-shaped iron core type (VR type) and a hybrid type (HB type).

In the printer 11 of the present embodiment, two types of paper feeding and paper transporting method are set to avoid a trouble such that a load resulting from the return operation of the hopper 15 and paper return levers 25 (hereinafter, the return operation that causes these mechanical load generating factors is termed as "ASF return operation") is applied and then, in a paper transport process, a step-out of the stepping motor 52 occurs and, hence, the printing is out of position. One of the methods is performed in a paper feed sequence, while the other method is performed in a paper transport sequence. The ROM 45 stores program data of a paper discharge process routine (main routine) shown in a flowchart of FIG. 7, a paper feed sequence (sub routine) shown in a flowchart of FIG. 8, and a paper transport sequence (sub routine) shown in a flowchart of FIG. 9. When the CPU 43 executes these programs, an appropriate one of the above two methods is selected in accordance with a print mode that is set at that time.

The method using the paper feed sequence is a method in which, first, the paper feed roller 22 rotates one revolution to feed a sheet of paper to a position at which the reset operation (hereinafter, referred to as "roller reset operation") is completed, and, in that case, because there is a possibility that the leading end setting position has been already passed, the sheet of paper is fed back after that, and then fed in a forward direction to perform the leading end setting (second paper feeding operation). In this case, because the ASF return operation has been already completed when the sheet of paper is set to the leading end setting position, no load resulting from the AFS return operation is applied to the stepping motor 52 during paper transporting. However, this method requires an additional operation, such as reverse feeding and second forward feeding, so that it is not suitable for a high speed print mode (high speed recording mode) that gives priority to printing speed than print quality.

Figure 4:
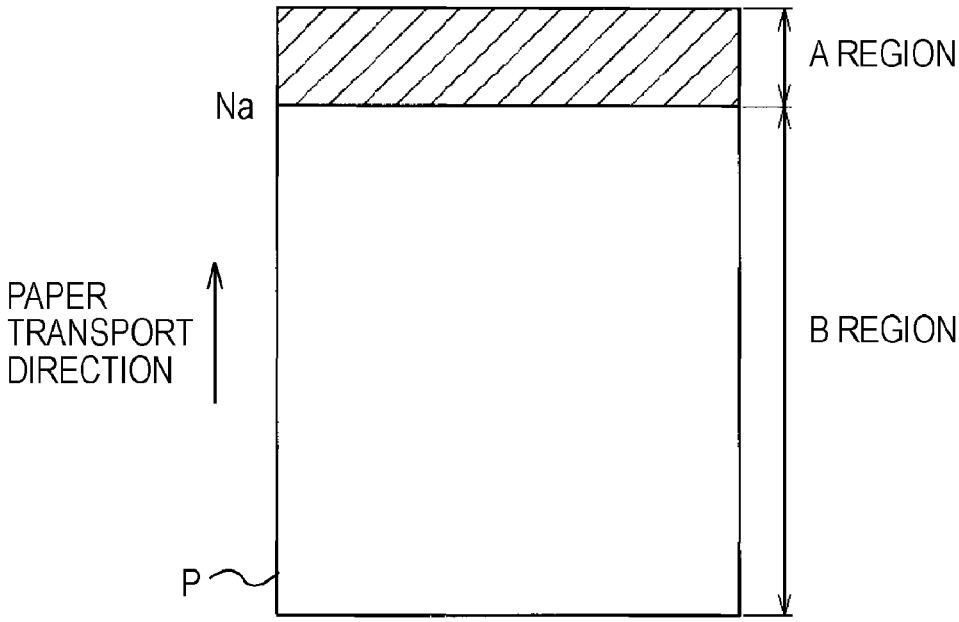
FIG. 4 is a plan view of a sheet of paper, illustrating an A region and a B region.

Then, in the high speed print mode, a method using the paper transport sequence is employed. FIG. 4 is a schematic view of a sheet of paper that shows a paper transport region to which a load of the ASF return operation is applied. In the drawing, the direction indicated by an arrow (upward direction) is a paper transport direction. Printing is performed from the upper end side of the sheet of paper line by line. Every time one line is printed, paper is transported intermittently by a prescribed amount of paper transport. Thus, printing is performed from the upper end side to the lower side. If the region, in which a load of the ASF return operation is applied, is defined as an A region, this A region corresponds to a paper transport region by which the sheet of paper is transported during a period when the ASF return operation is performed (loading period); this is determined unambiguously depending on the model of the printer 11. The A region, for example, becomes a region that ranges from the distal end of the sheet of paper (the upper end in FIG. 4) in a constant distance (for example, a value that ranges from 10 to 50 mm). This constant distance is determined by the diameter of the paper feed roller 22, the amount of transport by which the sheet of paper is transported during a period from the time the sheet of paper has been pushed out by the paper feed roller 22 to the time when the ASF return operation is completed, and the like.

That is, the A region shown in FIG. 4 is set such an area on the sheet of paper P that the sheet of paper P, which is transported in an operation period (loading period) during which the ASF return operation is performed, passes the reference position (position indicated by a solid inverted triangle in FIG. 2) of the recording head 19. A transported distance, by which the sheet of paper P is transported from the time when the paper detector 33 is turned on to the time when the ASF return operation is completed, that is, the counted value of the counter 61, is determined as a constant value depending on the model of the printer 11. Therefore, when the counted value N of the counter 61 is below Na (N<Na) where a counted value corresponding to the constant value is "Na", it is judged that the position opposite the head reference position on the sheet of paper P1 (hereinafter, referred to as "transporting position" of the sheet of paper P) is in the A region. This counted value Na is a counted value corresponding to a boundary between the A region, to which a load of the ASF return operation is applied, and the B region, to which no load is applied, as shown in FIG. 4. The counted value Na is a threshold value with which it is judged whether the transporting position of the sheet of paper P1 is in the A region or in the B region. Note that the A region corresponds to a setting region, and the B region corresponds to a region after the setting region has passed.

Figure 5:
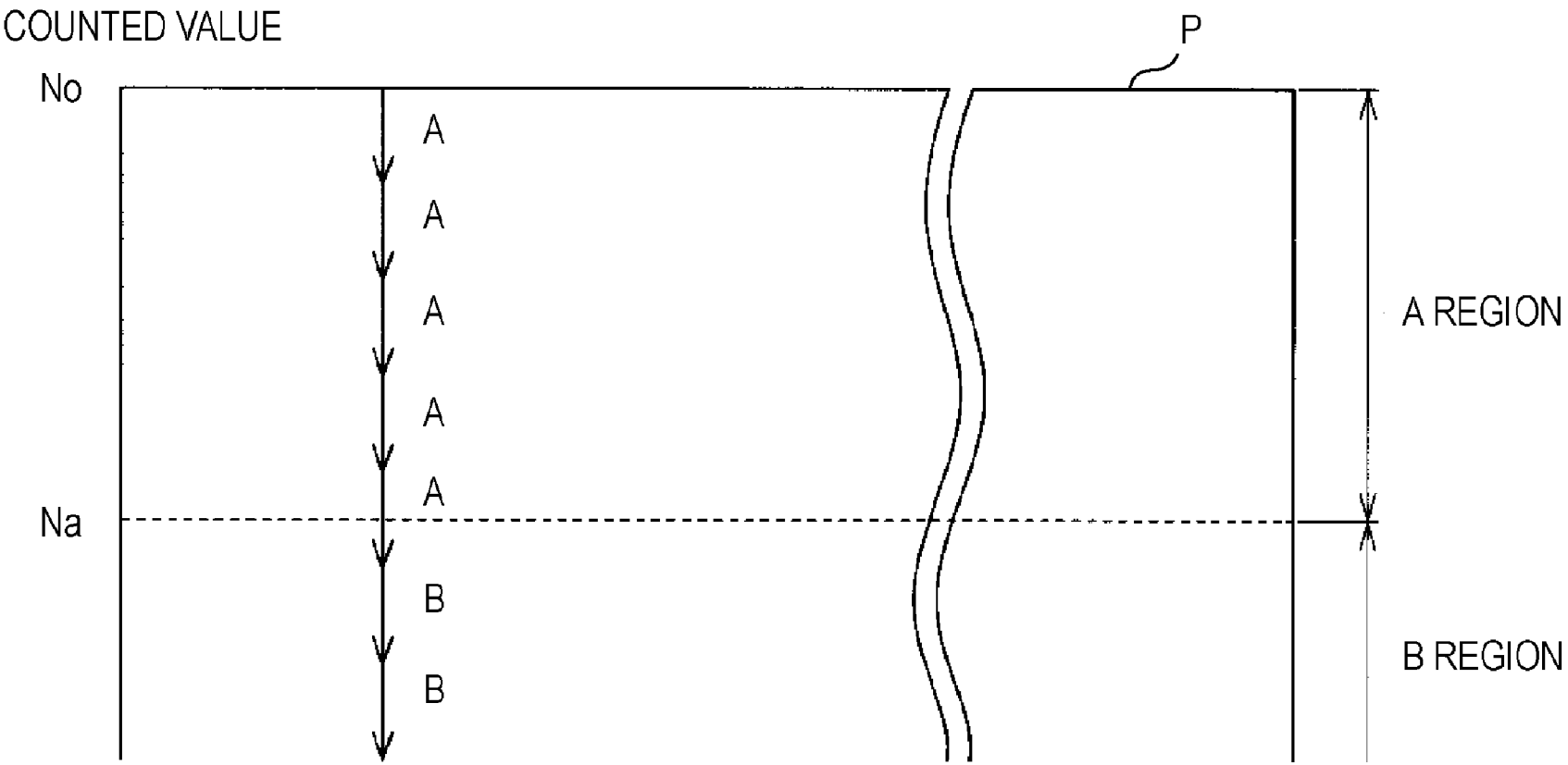

FIG. 5 is a schematic view of a sheet of paper, illustrating two types of paper transport mode, which are set for paper transport in the A region and in the B region. Note that FIG. 5 is an example in which the distal end of the sheet of paper P (No in the counted value) is set as the leading end setting position. The paper transport sequence provides two types of paper transport mode, which are an A mode for the A region and a B mode for the B region. The sheet of paper P1 after the leading end setting is transported intermittently in the auxiliary scanning direction every time one line is printed by a single printing operation; however, as shown in the drawing, the sheet of paper P1 is transported in a high torque A mode when the transporting position of the sheet of paper P is located in the A region (in the counted value, N<Na) while it is transported in a low torque B mode when it has entered the B region. The ROM 45 stores various table data, such as a voltage value table that determines a paper transport torque shown in FIG. 6 and an acceleration/deceleration table that determines a speed and acceleration/deceleration profile of paper transport for each of two types of paper transport mode (A mode, B mode).

Figure 6:
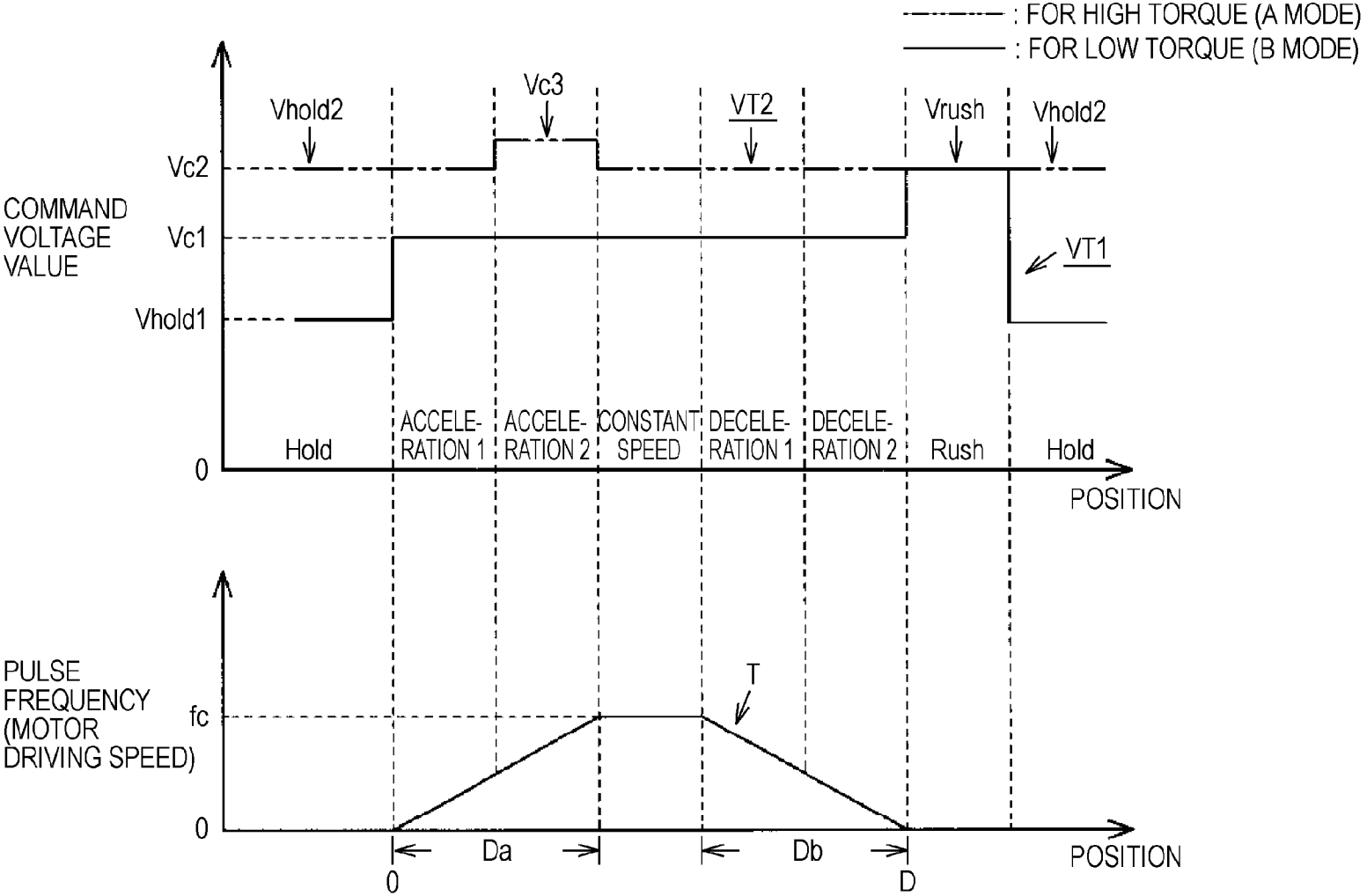
FIG. 6 is a graph that shows a voltage value table and an acceleration/deceleration table.

FIG. 6 is a graph that shows waveforms of voltage value tables VT1, VT2 and an acceleration/deceleration table T. The acceleration/deceleration table T is a table that shows a correspondence relationship between a position (the number of steps) and a pulse frequency. Here, the pulse frequency is a frequency of current pulse that is supplied to the exciting coil of the stepping motor 52. The CPU 43 controls the pulse frequency of each of the current pulses that are supplied to the exciting coils of the respective phases forming the stepping motor 52 so as to attain a value acquired by referring to the acceleration/deceleration table T in accordance with the position (the number of steps) at that moment and, thereby, controls a driving speed of the stepping motor 52. The CPU 43 inputs, from the motor driver 50, a pulse signal corresponding to a current pulse supplied from the motor driver 50 to the stepping motor 52, which will be counted by a counter (not shown). This counter is reset in advance of initiation of driving of the stepping motor 52 for starting paper transport, and counts a counted value corresponding to a position from a leading point to a terminal point in a single paper transport process. Then, the CPU 43 refers to the acceleration/deceleration table T and instructs the motor driver 50 using driving data that include a pulse frequency determined in accordance with the counted value (position) of this counter as portion of data.

The waveform of the acceleration/deceleration table shown in FIG. 6 contains a constant speed region for easy description; however, the acceleration/deceleration table T is constituted of a group of data in an acceleration process and a group of data in a deceleration process. A target speed, which is a speed in the constant speed region, is determined by a maximum frequency fc (target frequency) among a group of data in an acceleration process. In addition, in the interval from the start acceleration to the end deceleration (stop), it is occasionally determined in accordance with the amount of paper transport (paper transported distance D) that is specified by a paper transport command contained in the print data. The data group in the acceleration process is separated into "acceleration 1, acceleration 2", and the data group in the deceleration process is separated into "deceleration 1, deceleration 2". Each of the separated intervals is set to have a specific profile (note that, in FIG. 6, the separated intervals for acceleration and the separated intervals for deceleration are respectively drawn with the same inclination.

On the other hand, the voltage value table shown on the upper side in FIG. 6 provides a low torque voltage value table VT1 that is indicated by a solid line in the drawing and a high torque voltage value table VT2 that is indicated by an alternate long and short dashes line. Because the resistance of each exciting coil of the stepping motor 52 is constant, by controlling a voltage applied to each exciting coil, an electric current value of current pulse that flows through each exciting coil is controlled. The electric current value determines a torque of the stepping motor 52. Thus, the CPU 43 refers to one of the voltage value tables, which is selected from the voltage value tables VT1, VT2 in accordance with a print mode that is set at that moment to determine a voltage value and instructs the motor driver 50 using the determined voltage value, thus the torque of the stepping motor 52 is determined in accordance with the instructed voltage value.

The voltage value tables VT1, VT2 are set in correspondence with an acceleration/deceleration table T. In the present embodiment, the voltage value tables VT1, VT2 are set in correspondence with the sections "acceleration 1", "acceleration 2", "constant speed", "deceleration 1", "deceleration 2" of the acceleration/deceleration table T, The low torque voltage value table VT1 shown in FIG. 6 is set to a constant voltage value Vc in the sections [acceleration 1, acceleration 2, constant speed, deceleration 1, deceleration 2]. The section "Rush" after completion of deceleration is a period when a relatively strong force (torque) is applied to suppress the rotor of the stepping motor 52 from overrunning beyond a stop position because of a force due to an inertia A voltage value Vrush (>Vc1) that is higher than the voltage value Vc1 is set in this section "Rush". In addition, a voltage value Vhold1 (0<Vhold1<Vc1) that is able to apply a torque, by which the rotor of the stepping motor 52 is held at a stop position, is set in the section "Hold" corresponding to a stop period for the stepping motor 52.

On the other hand, in the high torque voltage value table VT2, a voltage value Vhold2 (>Vhold1) that is higher than the voltage value Vhold1 is set in the section "Hold" corresponding to the stop period for the stepping motor 52. Then, the sections "acceleration 1, constant speed, deceleration 1, deceleration 2", which belong to a driving period of the stepping motor 52, are set with a voltage value Vc2 (>Vc1) that is higher than the voltage value Vc1. The section "acceleration 2" is set with a voltage value Vc3 (>Vc2) that is higher than the voltage value Vc2. Only the section "Rush" is set with the same voltage value Vrush as the low torque one. In the present embodiment, as is apparent from the graph of FIG. 6, the voltage values of Vhold2, Vc2, and Vrush are set to the same value. Note that the setting values may be appropriately varied within the range that satisfies Vhold2>Vhold1, or Vc2>Vc1. In the case where Vc2>Vc1 as well, it is sufficient that at least one of the sections, among acceleration 1, acceleration 2, constant speed, deceleration 1, deceleration 2, where a step-out of the stepping motor 52 may possibly occur due to a load resulting from the ASF return operation, satisfies Vc2>Vc1, and the other sections may be set with Vc2=Vc1.

The present embodiment employs a configuration in which the high torque voltage value table VT2 also serves as a paper feeding voltage value table. The voltage value Vc3 in the section "acceleration 2" is set to a value higher than the voltage value Vc2 in the other sections "acceleration 1, constant speed, deceleration 2" in the high torque voltage value table VT2 shown in FIG. 6. This is because the high torque voltage value table VT2 is also used as the paper feeding voltage value table. This is because a relatively large load is applied to the paper feed roller 22 at the time when the circular arc surface 22*a* of the paper feed roller 22 initiates to contact a sheet of paper P to start pushing out, so that, in the section "acceleration 2" that overlaps the timing of this start of pushing out, a relatively high voltage value Vc3 is set in order to obtain a torque that overcomes the load. Thus, if a configuration in which the paper feeding voltage value table is additionally provided and the voltage value table VT2 does not serve as the paper feeding voltage value table is employed, even in the section "acceleration 2", the voltage is set to the same voltage value Vc2 as those in the other sections. Note that, in the present embodiment, the torque that is specified by the low torque voltage value table VT1 corresponds to a second torque, and the torque that is specified by the high torque voltage value table VT2 corresponds to a first torque. Furthermore, the section "acceleration 2" corresponds to a period during which a load resistance is received, and the torque that is specified by the command voltage value Vc3 in this "acceleration 2" corresponds to a torque that is applied in the period during which a load resistance is received. Moreover, the section "Hold" corresponds to a stop period. The torque that is specified by Vhold2 corresponds to a stop torque in a loading period. The torque that is specified by "Vhold1" corresponds to a stop torque during a period after the loading period has passed.

FIG. 6 is one example of the acceleration/deceleration table. A plurality of the acceleration/deceleration tables T are provided respectively and separately for the low torque and for the high torque. Specifically, the plurality of acceleration/deceleration tables T having different target speeds as a speed in the constant speed region (that is, the maximum frequency fc) are provided respectively for the low torque and for the high torque. As shown in FIG. 6, in the acceleration/deceleration table T, in order to be able to reach the target frequency fc (target speed), the sum (Da+Db) of a moving distance that is required to accelerate from an acceleration start point to the target frequency fc (acceleration distance Da) and a moving distance that is required to decelerate from the target frequency fc to the stop position (deceleration distance Db) is needed as a minimum driving distance. Thus, in order to be able to apply the acceleration/deceleration table T, a transported distance D needs to be equal to or greater than the minimum driving distance (Da+Db) that is determined for each of the acceleration/deceleration tables T.

For example, in the A mode, that is, the high torque paper feed mode, if the amount of paper feed that is determined through the command is a transported distance D, one of the plurality of acceleration/deceleration tables T that are provided for the high torque, which satisfies a minimum distance condition in which the minimum driving distance (Da+Db) is equal to or below this transported distance D and which gives a maximum target speed (that is, a maximum frequency fc) is selected. Selection of the acceleration/deceleration table during paper feeding is also performed in the same way. In addition, selection of an acceleration/deceleration table in the B mode, that is, the low torque paper feed mode, is also performed in the same way. This is to improve the throughput of printing by performing paper feed and paper transport at the highest possible speed.

Note that the target frequency fc of the high torque acceleration/deceleration table T differs from the target frequency fc of the low torque acceleration/deceleration table T, even when the target frequencies fc are determined on the basis of the same transported distance. This is because, in the paper feeding operation, the acceleration/deceleration profile of the high torque acceleration/deceleration table that is also used in the paper feeding operation is set to give priority to a reliable transport to the leading end setting position, while, on the other hand, in the paper transport operation, the acceleration/deceleration profile of the low torque acceleration/deceleration table is set to give priority to the accuracy of stop positions. In the present embodiment, the transport speed based on the high torque acceleration/deceleration table is set slower than the transport speed based on the low torque acceleration/deceleration table. Of course, the transport speed may be set to the same speed between the high torque table and the low torque table, or the transport speed may be set to the opposite relationship between the high torque table and the low torque table with respect to the present embodiment.

A user displays a print setting screen on a display device 35*a* of the host computer 35 shown in FIG. 1 and is able to select and set print condition information (recording condition information) with this print setting screen. The user manipulates an input device 35*b* to input and set printing parameters, such as "paper type", "paper size", "print quality", and "layout", as the print condition information. The choices of "paper type" are, for example, "plain paper, postcard, glossy paper, photo mat paper, or the like". The choices of "paper size" are "A4, 8×10, 2L, L, and the like". In addition, there are three choices of "print quality": "high speed (fast)", "standard", and "high image quality (fine)". The choices of "layout" are "borderless, bordered". The print condition is set by selecting one choice in each item.

Here, "high speed" in print quality is a choice that gives higher priority to printing speed than printing image quality, "standard" is a choice that requires a standard level for both printing speed and printing image quality, and further "high image quality" is a choice that gives higher priority to printing image quality than printing speed. Note that, when a special paper (for example, a photo print paper (glossy paper, or the like)) that is used when an image is finely printed with a high printing resolution is selected as a selected item "paper type", print quality "fine" is automatically selected.

When "high speed" is selected, a low printing resolution (for example, "720 dpi") is set as a printing resolution, and "bidirectional printing" is selected as a printing method. When "standard" is selected, a standard printing resolution (for example, "1440 dpi") is selected, and "unidirectional printing" is set. Furthermore, when "high image quality" is selected, a high resolution (for example, "2880 dpi") is selected, and "unidirectional printing" is set.

The printer driver of the host computer 35 converts image data of a predetermined display resolution that is displayable on the display device 35*a* into the above described predetermined printing resolution that is determined in accordance with the choice regarding the print quality, and the like, among the printing parameters. Moreover, a color conversion process in which a color system of the image data (for example, RGB color system) to a CMYK color system data, a halftone process in which the data are converted to gray-scale values that are reproducible by the printer 11, and a rasterization process (Micro weave process) in which the data are sorted in the order that the data should be transferred to the printer 11 (in the order of discharge) are sequentially executed. Then, print data are generated by attaching a command, which instructs the printer 11 on a control, to the header of printing image data that are generated through the above series of processes. This header contains one piece of information that is set by a user or set automatically among the choices "high speed", "standard", and "fine" in the print quality item. The CPU 43 of the printer 11 acquires the choice (set value) regarding "print quality", which is contained in the header of initial print data that are received from the host computer (that is, the printer driver), and then determines a print mode in accordance with the set value.

In the present embodiment, when "high speed" is selected as the print quality, "high speed printing mode (economy mode)" (high speed recording mode) is set, when "standard" is selected, "normal printing mode" is set, and, further, when "high image quality" is selected, "high image quality printing mode" (low speed recording mode, high quality recording mode) is set. In the "high speed printing mode", a low printing resolution print is performed by a bidirectional printing that performs printing in both forward and reverse movement of the carriage 18. In addition, in the "normal mode", a standard printing resolution print is performed by a unidirectional printing that performs printing in only one direction between the forward and reverse movement of the carriage 18. Moreover, in the "high image quality printing mode", a high printing resolution print is performed by the unidirectional printing. Note that the CPU 43 interprets a command contained in the header of the print data that are received from the host computer and acquires the amount of paper feed (the distance D while paper feeding in FIG. 6) corresponding to the leading end setting position of the sheet of paper P1 and the amount of paper transport (the distance D while paper transporting in FIG. 6) in the paper transport operation (transport operation), which is alternately performed with the printing operation for the sheet of paper P1 after the leading end setting. In the present embodiment, the CPU 43 that sets a print mode (recording mode) constitutes a recording mode setting means.

In the present embodiment, the CPU 43 executes a paper feed sequence when paper feed is performed, and executes a paper transport sequence when paper transport is performed. The paper feed sequence provides a first paper feed sequence and a second paper feed sequence. The CPU 43, in accordance with a print mode (recording mode) that is determined on the basis of a set value regarding "print quality" acquired from the header of print data (including a case where print quality is automatically set through "paper type"), selects the first paper feed sequence (first feed sequence) when the print mode is "high speed print mode" and selects the second paper feed sequence (second feed sequence) when the print mode is "normal print mode" or "high image quality print mode". Note that "high speed print mode", in which the first feed sequence is performed, corresponds to a first recording mode, and "normal print mode" and "high image quality print mode", in which the second feed sequence is performed, correspond to a second recording mode.

Note that, in the present embodiment, the print mode includes three grades "high speed print", "normal", and "high image quality"; however, the print mode may be configured to include two grades or four grades or more. In addition, the printing parameter that determines a print mode is not limited to "print quality" (including a case where the print mode is set automatically through "paper type"); a method by which the print mode is determined through another printing parameter or a combination of "print quality" and another parameter may be employed. For example, it is applicable that a printing parameter by which a user is able to select the on or off of "bidirectional printing" is provided, and a high speed print mode is set when the "bidirectional printing" is selected, while a low speed print mode is set irrespective of a printing resolution when the "bidirectional printing" is not selected (that is, "unidirectional printing").

Figure 7:
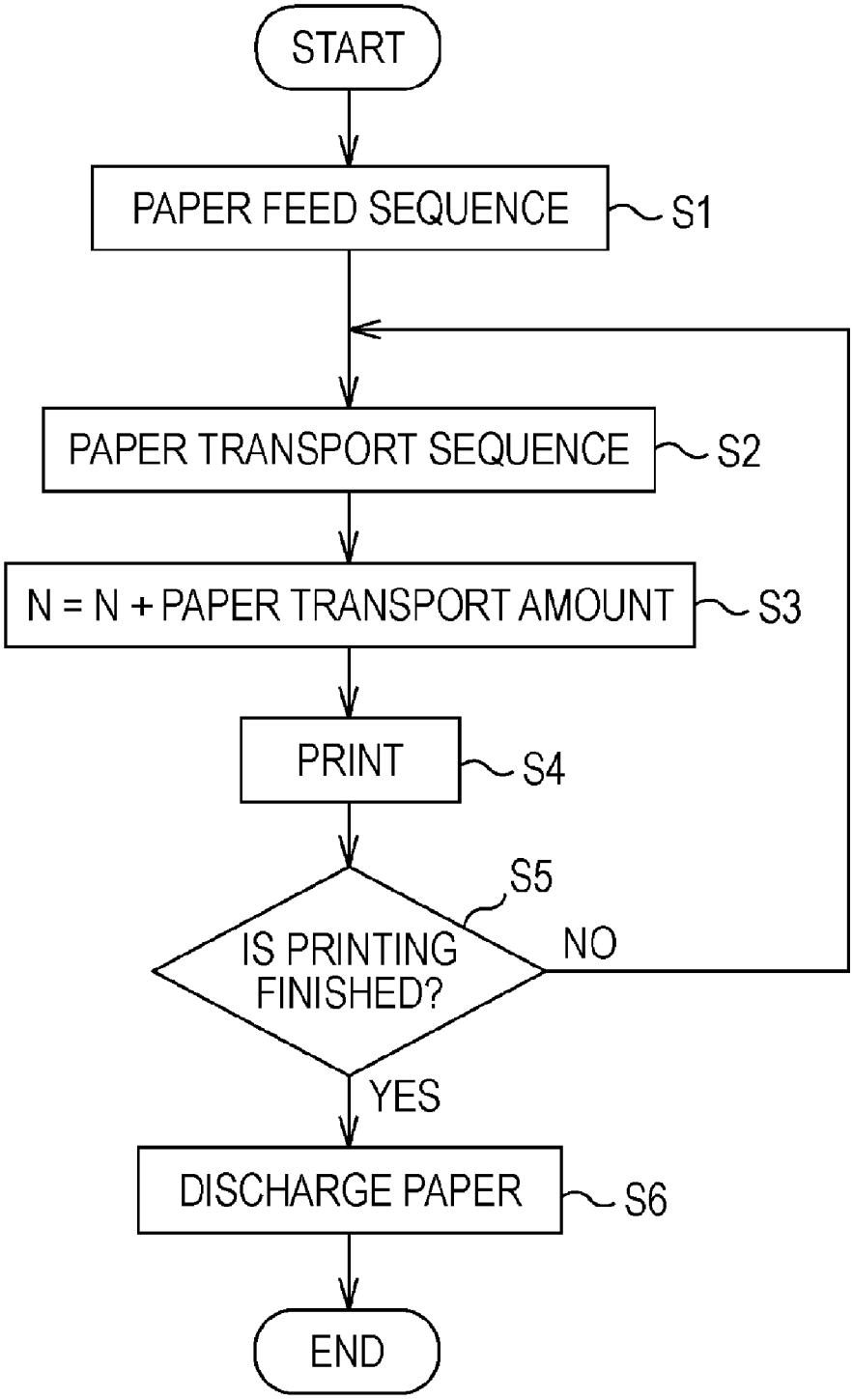
FIG. 7 is a flowchart that shows a paper feed and paper transport process.
Figure 8:
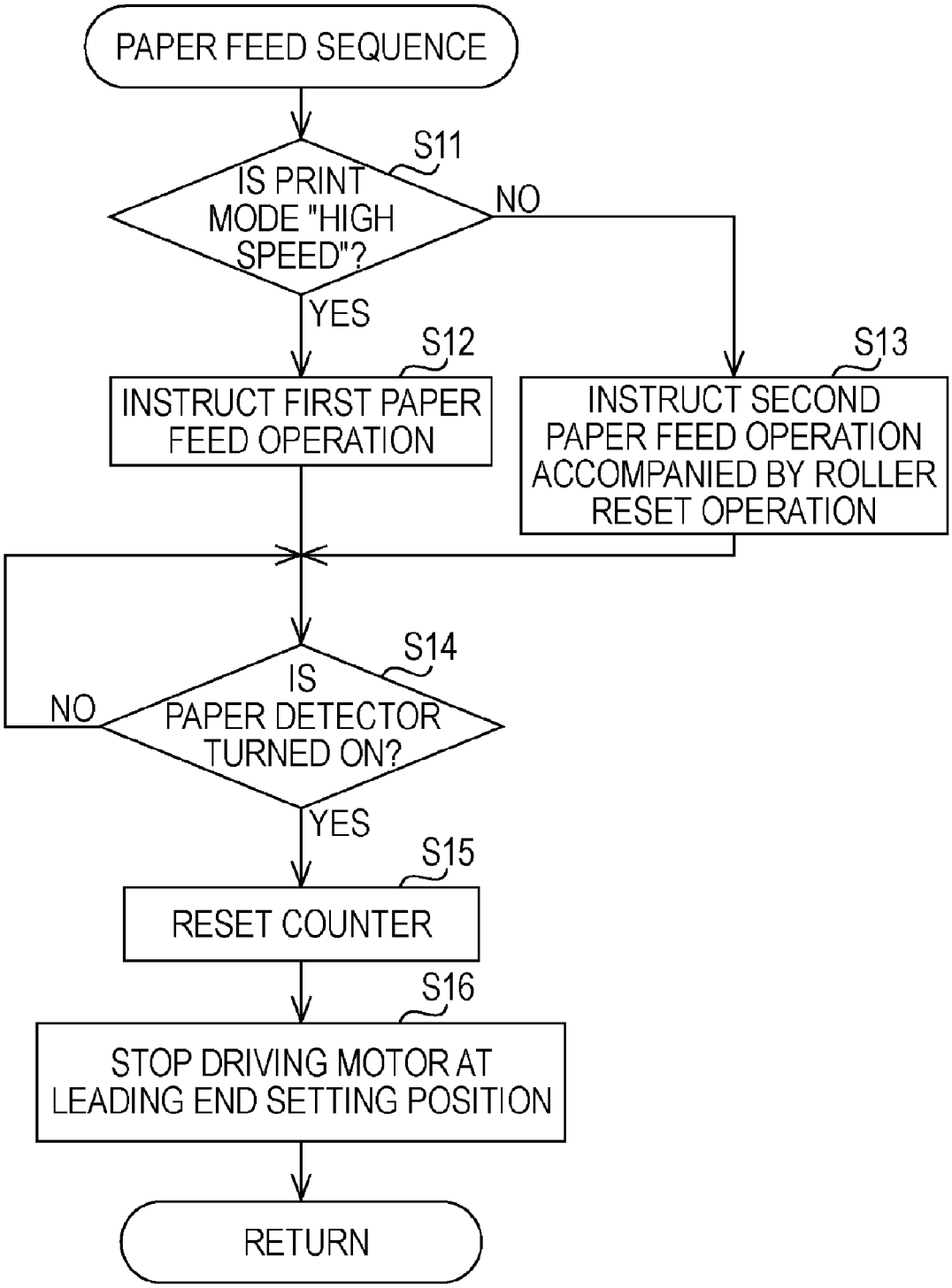
FIG. 8 is a flowchart that shows a paper feed sequence.
Figure 9:
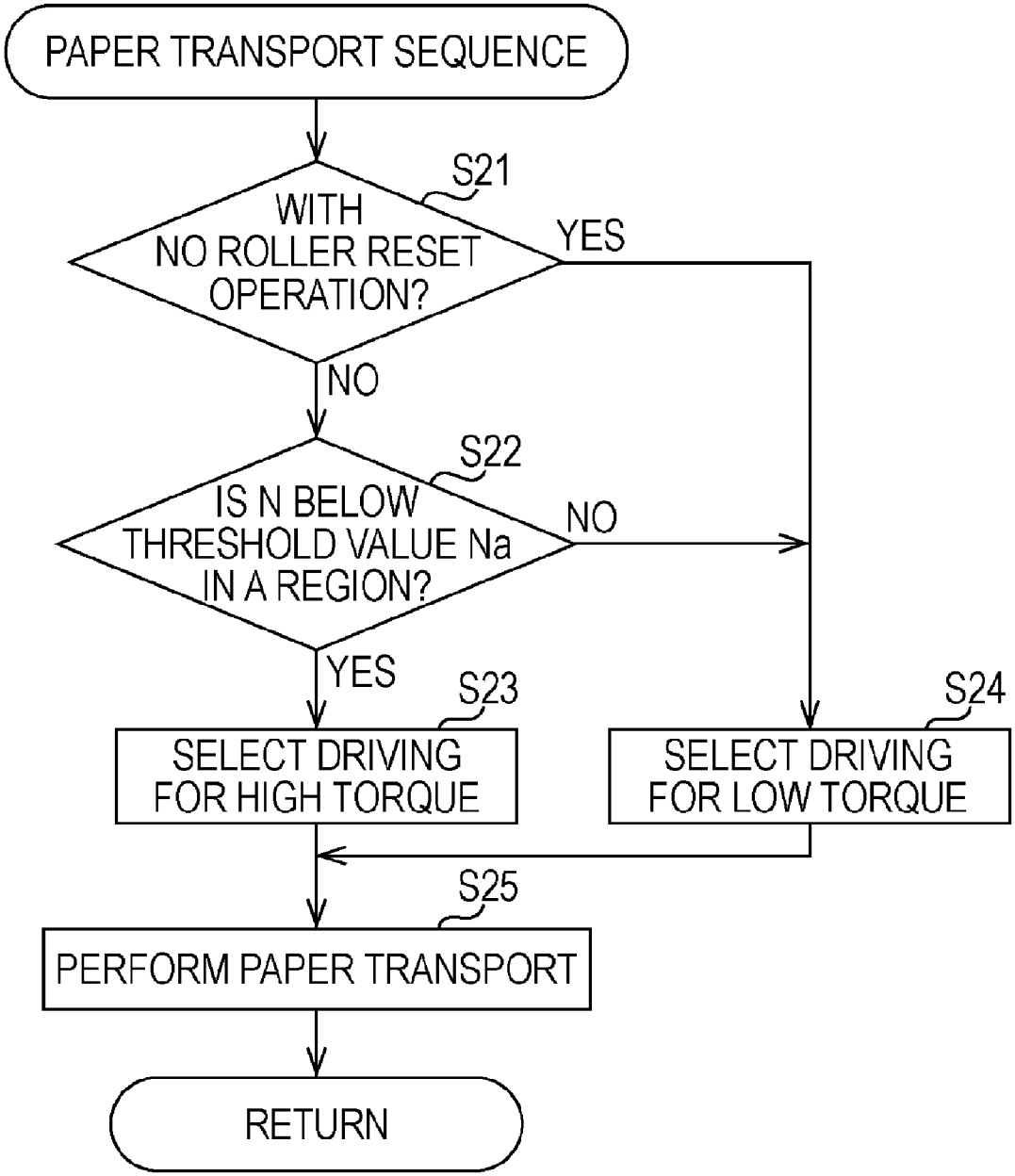
FIG. 9 is a flowchart that shows a paper transport sequence.

The paper feed and paper transport processing routine executed by the CPU 43 will now be described with reference to FIG. 7 to FIG. 9. In step S1, a paper feed sequence is executed. That is, by executing a sub-routine of the paper feed sequence shown in FIG. 8 to drive the ASF 13 and the paper transport rollers 29, feeding of the sheets of paper P is performed. Through this paper feeding operation, the sheet of paper P1 is set to a leading end setting position.

In the next step S2, a paper transport sequence is executed. That is, by executing a sub-routine for paper transport sequence shown in FIG. 9, the sheet of paper P1 is transported. In step S3, the amount of paper transport by which the sheet of paper P is transported in the paper transport sequence is added to the counted value N in the counter 61 (N=N+(amount of paper transport)).

In step S4, printing is performed. That is, by driving the carriage motor 51 to move the carriage 18 in the main scanning direction X across a printing area, printing of one line (one pass) is performed by discharging ink droplets from the nozzles of the recording head 19 in the process of that movement. Note that, when the paper feed sequence (S1) is completed and, thereby, the sheet of paper P1 has been set to a leading end setting position, the paper transport sequence (S2) and the counting process (S3) by the counter are omitted and the process proceeds to printing in step S4. Thus, initial printing will be performed on the sheet of paper that is set to the leading end setting position.

In step S5, it is judged whether printing is completed or not. When printing is not completed, the process proceeds to step S2. When printing is completed, the process proceeds to step S6. In step S6, paper discharge is performed. That is, by driving the stepping motor 52 to rotate the paper discharge rollers 30, and the like, the sheet of paper P1 is discharged.

The paper feed sequence will now be described with reference to FIG. 8. The CPU 43 sets "high speed print mode" when the print quality is "high speed", sets "normal print mode" when the print quality is "standard", and further sets "high image quality print mode" when the print quality is "high image quality". Other than the above, a high image quality print mode may possibly be set prior to the item of print quality in accordance with the setting items of the printing parameters other than the print quality (for example, the paper type is "photo paper").

First, in step S11, it is judged whether the print mode is "high speed". When it is "high speed", the process proceeds to step S12. When it is not "high speed" (that is, "normal" or "high image quality"), the process proceeds to step S13.

In step S12, the first paper feeding operation is instructed. That is, the CPU 43 instructs the motor driver 50 using driving data and a voltage value to make the stepping motor 52 perform the first paper feeding operation. Specifically, first, the transported distance D (the amount of paper feed) required to feed a sheet of paper to the leading end setting position and a value corresponding to a counted value of the counter 61 required to feed a sheet of paper to the leading end setting position are acquired from the header of the print data. As the transported distance D is determined, the acceleration/deceleration table T that satisfies the minimum distance condition where the minimum driving distance (Da+Db) becomes this transported distance (Da+Db) or below and that gives a maximum target speed (target frequency fc) is selected among the plurality of provided high torque acceleration/deceleration tables. Then, from a paper feed start position, driving data that contain a pulse frequency, as one piece of data, that is determined in accordance with a position at that moment are instructed to the motor driver 50 by referring to the selected acceleration/deceleration table T, and a voltage value that is determined in accordance with a position (section) at that moment is instructed to the motor driver 50 by referring to the high torque voltage value table VT2. The motor driver 50 generates, for each phase, a voltage pulse that has the pulse frequency f contained in the driving data and the voltage value instructed, and applies it to the exciting coil of each phase of the stepping motor 52. As a result, the exciting coils of the stepping motor 52 are applied with A-phase and B-phase current pulses that, for example, have amplitudes of current values proportional to the applied voltage values. Thus, as the stepping motor 52 rotates by a predetermined amount of rotation corresponding to the transported distance D in forward rotating direction, the normal paper feeding operation (first paper feeding operation), in which the ASF 13 supplies a sheet of paper P1 only in the transport direction, is performed. Hence, of the sheets of paper stacked on the hopper 15, the uppermost one sheet is fed in the transport direction (auxiliary scanning direction Y) by the operation of the ASF 13 and then transported to the leading end setting position.

On the other hand, when the print mode is not "high speed" (NO in S11), that is, when the print mode is "normal" or "high image quality", the second paper feeding operation that is accompanied by a roller reset operation is instructed in the following step S13. This second paper feeding operation includes three operations: the roller reset operation in which the paper feed roller 22 is rotated one revolution to be reset, a reverse feeding operation in which a sheet of paper P, which is possibly fed beyond the leading end setting position by the roller reset operation, is reversely fed in the counter transport direction until the paper detector 33 enters a non detection state (turned OFF), and a leading end setting operation in which, after the reverse feeding operation is completed, the sheet of paper P is fed in the transport direction to the leading end setting position again. The CPU 43 instructs the motor driver 50 using the driving data and the voltage value to perform the second paper feeding operation. First, of the second paper feeding operation, the roller reset operation is instructed. Because the transported distance D that is necessary for the roller reset operation is known in advance, from a paper feed start position, driving data that contain a pulse frequency f, as one piece of data, that is determined in accordance with a position at that moment are supplied to instruct the motor driver 50 by referring to the acceleration/deceleration table T that is determined on the basis of that known transported distance D, and a voltage value that is determined in accordance with a position (section) at that moment is supplied to instruct the motor driver 50 by referring to the low torque acceleration/deceleration table. Data that instruct a motor rotating direction are contained in the driving data as another one piece of data. This time the forward rotating direction is instructed as the command data. As the thus roller reset operation is completed, subsequently, the reverse feeding operation and the leading end setting operation are sequentially performed by executing speed control and torque control in accordance with respective transported distances, and then the sheet of paper P1 is transported to the leading end setting position by the leading end setting operation. Note that, as data to instruct a motor rotating direction, the reverse rotating direction is instructed when in the reverse feeding operation, and the forward rotating direction is instructed when in the leading end setting operation.

In step S14, it is judged whether the paper detector 33 is turned ON. That is, it is judged whether the paper detector 33 is turned on in such a manner that the distal end of the sheet of paper P1, which is fed toward the leading end setting position, pushes the lever 31 of the paper detector 33. When the paper detector 33 is turned ON, the process proceeds to step S15. When the paper detector 33 is not turned ON (that is, it remains turned OFF), the process waits until the paper detector 33 is turned ON. Note that the CPU 43, in terms of control, is configured to ignore that the paper detector 33 is turned ON in the midway of the roller reset operation within the second paper feeding operation.

In step S15, the counter 61 is reset. Then, whenever in the first paper feeding operation or in the second paper feeding operation, the counter 61 is reset when the sheet of paper P1 in the midway of the leading end setting turns on the paper detector 33. By this resetting of the counter 61, the counter 61 sets "0" when the paper detector 33 is turned ON and counts the number of pulses corresponding to a transported distance by which the sheet of paper P is transported from the origin "0".

In step S16, driving of the stepping motor 52 is stopped at the leading end setting position. The transported distance from the position detected by the paper detector 33 to the leading end setting position is known from a paper feed command in the header of the print data. Thus, when the counted value N of the counter 61 reaches a value Nh corresponding to the leading end setting position, driving of the stepping motor 52 is stopped. In this case, deceleration is initiated at a deceleration start position (Nh−Db) such that the leading end setting position becomes a stop position in the acceleration/deceleration table T employed at that moment, and then the sheet of paper P1 is stopped at the leading end setting position Nh. Thus, the paper feed sequence ends. Note that the CPU 43 that executes the processes of steps S11, S12, S14 to S16 to perform the first paper feed sequence and that executes the processes of steps S11, S13, S14 to S16 to perform the second paper feed sequence constitutes a control means.

When printing is performed on the sheet of paper P1 of which the leading end is set in the paper feed sequence, the paper transport operation is subsequently performed alternately with the printing operation. This paper transport operation is performed in accordance with the paper transport sequence shown in FIG. 9. The paper transport sequence will now be described with reference to FIG. 9.

In step S21, it is judged whether no roller reset operation is performed. That is, it is judged whether the paper feeding operation that has been performed in the paper feed sequence is the first paper feeding operation that is not accompanied by the roller reset operation. Of course, it may be judged whether the print mode is a high speed print mode, or whether the print quality is "high speed". When it is judged that no roller reset operation has been performed, the process proceeds to step S22. When it is judged that the roller reset operation has been performed, the process proceeds to step S24.

In step S22, it is judged whether the counted value N of the counter 61 is below a threshold value Na (N<Na). That is, it is judged whether the transporting position of the sheet of paper P1 is within the A region. When N<Na, the process proceeds to step S23. When N≧Na, the process proceeds to step S24. Note that the CPU 43 that executes the process of this step S22 constitutes a judging means that judges whether it is in a loading period during which a load of the feeding device is applied to the driving source.

In step S23, driving for high torque is selected. Specifically, from a paper transport command contained in the header of the print data, the transported distance D (the amount of paper transport) that is required as a value corresponding to the counted value of the counter 61 is acquired. As the transported distance D to be transported is determined, the acceleration/deceleration table T that satisfies the minimum distance condition where the minimum driving distance (Da+Db) is this transported distance (Da+Db) or below and that gives a maximum target speed (target frequency fc) is selected among the plurality of provided high torque acceleration/deceleration tables T. Then, the high torque (A mode) voltage value table VT2, shown in FIG. 6, which is in correspondence with the selected acceleration/deceleration table T, is selected.

In step S24, the driving for low torque is selected. Specifically, from a paper transport command in the header of the print data, the required transported distance D (the amount of paper transport) is acquired. As the transported distance D to be transported is determined, the acceleration/deceleration table T that satisfies the minimum distance condition where the minimum driving distance (Da+Db) is this transported distance (Da+Db) or below and that gives a maximum target speed (target frequency fc) is selected among the plurality of provided low torque acceleration/deceleration tables T. Then, the low torque (B mode) voltage value table VT1, shown in FIG. 6, which is in correspondence with the selected acceleration/deceleration table T, is selected.

In step S25, paper transport is performed. That is, from a paper transport start position, driving data, which contain speed data (pulse frequency) determined in accordance with a position at that moment by referring to the selected acceleration/deceleration table T and a voltage value determined in accordance with a position at that moment by referring to the selected voltage value table VT1 or VT2, are supplied to instruct the motor driver 50.

For example, as shown in FIG. 5, when the transporting position of the sheet of paper P1 is within the A region (N<Na), the stepping motor 52 is driven on the basis of the high torque voltage value table VT2, and paper transport is performed in the high torque A mode. Then, when paper transport passes the boundary between the A region and the B region (indicated by a broken line that indicates a transporting position at which the counted value N in FIG. 5 becomes a threshold value Na), a driving condition for the present paper transport is selected on the basis of the counted value N (<Na) that is just before the paper transport passes the boundary and then N<Na is satisfied, so that a driving condition for high torque is selected. As a result, when the paper transport is performed to pass the boundary from the A region to the B region, the paper transport is performed in the high torque A mode.

On the other hand, when paper transport is initiated from a position at which the transporting position N of the sheet of paper P1 has already exceeded the threshold value Na, then N≧Na is satisfied, so that a driving condition for low torque is selected. As a result, when paper transport is initiated from a position on the boundary or that has passed the boundary, the paper transport is performed in the low torque B mode. Thus, as shown in FIG. 5, in the A region, the paper transport is performed in the high torque A mode, so that the occurrence of a step-out of the stepping motor 52 is avoided. In addition, in the B region that is sufficiently longer than the A region, the paper transport is performed in the low torque B mode, so that it requires a low electric power and it is possible to suppress a noise during paper transport. Then, the paper transport that passes the boundary between the A region and the B region is performed with the high torque, so that it is possible to reliably prevent a step-out of the stepping motor 52. Note that the CPU 43, which executes the processes of steps S21 to S23, and S25 to perform high torque transport during a loading period and that executes the processes of steps S21, S22, S24, and S25 to perform low torque transport during a period after the loading period has passed, constitutes a control means.

Figure 10:
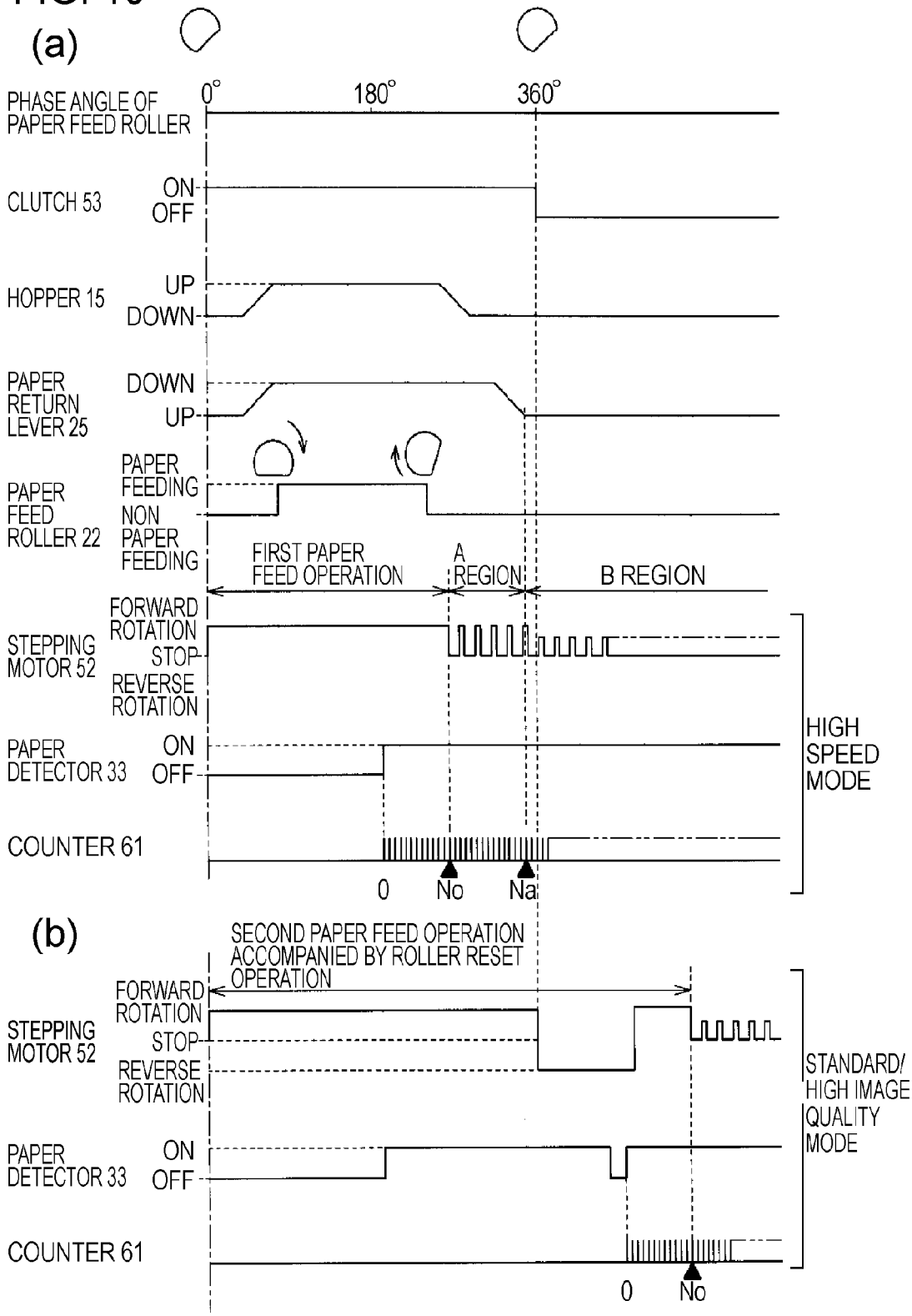
FIG. 10(*a*) is a timing chart that shows a first paper feed sequence and a paper transport sequence.

FIG. 10 is a timing chart that illustrates a paper feed and paper transport operation of the printer 11. FIG. 10(*a*) shows a paper feed and paper transport operation when in a high speed print mode. FIG. 10(*b*) shows a paper feed and paper transport operation when in a standard or high image quality print mode. FIG. 10(*a*) shows, from the upper side, a phase angle of the paper feed roller, a connected state of the clutch 53 (ON indicates connected, OFF indicates disconnected), a state of the hopper 15 (UP indicates a paper feed position, DOWN indicates a rest position), a state of the paper return levers 25 (DOWN indicates a rest position, UP indicates an upright position) and a state of the paper feed roller 22 (paper feeding/non-paper feeding). In addition, below the above items, the control contents for the stepping motor 52, ON/OFF of the paper detector 33, and the counted value of the counter 61 are respectively shown Note that FIG. 10(*b*) only shows a state of the stepping motor 52, a state of the paper detector 33, and a state of the counter 61 because a state of the phase angle of the paper feed roller, a state of the clutch 53, a state of the hopper 15, a state of the paper return levers 25, and a state of the paper feed roller 22 are the same as those of FIG. 10(*a*).

While the paper feed roller 22 is being rotated one revolution from the reset position (0°), first, the hopper 15 is raised to the paper feed position and the paper return levers 25 are tilted to the rest position. After that, the circular arc surface 22*a* of the paper feed roller 22, being rotated, contacts a sheet of paper P on the hopper 15 to initiate paper feed (see FIG. 2(*b*)), and further feeding of a sheet of paper proceeds as the paper feed roller 22 rotates. At the timing when the fed sheet of paper P1 is nipped by the paper transport rollers 29, the circular arc surface 22*a* of the paper feed roller 22 is separated from the sheet of paper P1. Thus, feeding of the sheet of paper P1 by the paper feed roller 22 is stopped. Immediately after that, the return operation of the hopper 15 is initiated. Then, slightly after the return operation by which the hopper 15 recedes, the paper return levers 25 are raised up. Owing to this raising operation of the paper return levers 25, the following other sheets of paper P, the distal ends of which enter a transport path between the paper feed roller 22 and the retard roller 24 are pushed back onto the hopper 15.

In the example of "high speed print mode", shown in FIG. 10(*a*), in which the print mode is a first recording mode, the first paper feeding operation by which a sheet of paper is fed only in the transport direction (auxiliary scanning direction Y) is performed as a paper feeding operation (first paper feed sequence). The leading end setting position of a sheet of paper is acquired from a command contained in the print data. When the paper detector 33 is turned on in the midway of paper feeding operation, the counter 61 is reset. When the counted value of the counter 61 reaches a counted value "No" corresponding to the leading end setting position, forward rotation driving of the stepping motor 52 is stopped. Because the counted value No of this leading end setting position as smaller than the threshold value Na of the A region (No<Na), the transporting position of the sheet of paper P1 is within the A region and the ASF return operation has not been completed. Then, while the transporting position of the sheet of paper P1 is within the A region, that is, the counted value N is below the threshold value Na, paper transport driving is performed in the A mode with a high torque (see VT2 of FIG. 6). Then, when the counted value N exceeds the value Na of the A region and becomes a value within the B region (N≧Na), paper transport driving is performed in the B mode with a low torque (see VT1 of FIG. 6). In this way, high speed printing is implemented by performing paper feed for a short time using the first paper feeding operation, and it is possible to avoid the occurrence of a step-out of the stepping motor 52. In addition, an electric power consumption is suppressed to a lesser degree in paper feeding in the B region. Because an electric power consumption is suppressed to a lesser degree, it is possible to suppress heating of the stepping motor 52 and a noise during paper transport driving to a lesser degree.

On the other hand, in an example in which the print mode shown in FIG. 10(*b*) is "normal print mode" or "high image quality print mode", the paper feeding operation (second paper feeding operation) that is accompanied by the roller reset operation is performed. That is, as shown in FIG. 10(*b*), first, the stepping motor 52 is driven in forward rotation until the roller reset operation is completed. As this forward rotation driving of the stepping motor 52 ends, the paper feed roller 22 completes the roller reset operation. Subsequently, the stepping motor 52 is driven in reverse rotation. As the paper detector 33 turns off when a sheet of paper is being reversely fed, the reverse rotation driving of the stepping motor 52 is stopped. Then, the stepping motor 52 is driven in forward rotation again. As the paper detector 33 detects the distal end of the sheet of paper to turn ON, the counter 61 is reset and counting is then started. When the counted value reaches the value No corresponding to the leading end setting position, the forward rotation driving of the stepping motor 52 is stopped. In this way, the second paper feeding operation (second paper feed sequence) that is accompanied by the roller reset operation ends. At the leading end setting position after the second paper feeding operation ends, the roller reset operation has been already completed, and an ASF return operation period, as a loading period, during which the ASF return operation is performed to apply a load on the stepping motor 52 has passed. Thus, paper transport after the leading end setting is always performed with a low torque in the B mode (see VT1 of FIG. 6). Thus, because it is possible to avoid the occurrence of a step-out of the stepping motor 52 and, in addition, to always suppress an electric power consumed in paper transport to a lesser degree, it is possible to suppress heating of the stepping motor 52 and a noise during paper transport driving to a lesser degree.

Note that a method may be applicable in which, when it is judged that the print mode is "high speed print mode" (when YES in S11), it is further judged whether the leading end setting position No is below the threshold value Na of the A region (No<Na), and then the first paper feeding operation (S12) or the second paper feeding operation (S13) is selected on the basis of the result of judgment. That is, the second paper feeding operation is performed when the leading end setting position No is below the value Na (No<Na), but the first paper feeding operation is performed when the leading end setting position No is equal to or above the threshold value Na (No≧Na). If the leading end setting position No is equal to or above Na (No≧Na), the roller reset operation is completed in the paper feed process when the sheet of paper P1 is fed to the leading end setting position No. Thus, it is unnecessary to perform three processes, that is, the roller reset operation in the transport direction, the reverse feeding operation in the counter transport direction, and the leading end setting operation in the transport direction; it is only necessary to perform paper feeding operation with a single process, the first paper feeding operation, which is performed in the transport direction only. Thus, when No≧Na, it is possible to improve a printing throughput by completing the paper feeding operation for a short time.

As described in detail above, according to the present embodiment, the following advantageous effects can be obtained.

(1) When the counted value N of the counter 61, which indicates a transporting position after the fed sheet of paper P1 is set to the leading end setting position, is below the value Na of the A region in which a load resulting from a load of the ASF 13 is applied, the stepping motor 52 is driven with a high torque to perform paper transport. On the other hand, when the counted value N of the counter 61 is equal to or greater than the threshold value Na of the A region and is within the B region in which no load resulting from a load of the ASF 13 is applied, the stepping motor 52 is driven with a low torque to perform paper transport. Thus, even when the leading end setting position of the sheet of paper P1 is in the midway of the return operation (ASF return operation) of the hopper 15 and paper return levers 25, which cause generation of a mechanical load, in a period during which a load of the return operation is applied, there is no risk to cause a step-out of the stepping motor 52 because of the high torque being applied, and, after completion of the return operation, it is possible to suppress an electric power consumed by driving the paper transport with a low torque. Thus, it is possible to suppress heating and noise of the stepping motor 52. In addition, because it is possible to perform a normal paper feeding operation (first paper feeding operation) by which a sheet of paper is fed once in the transport direction, a high throughput of printing may be maintained. Thus, it is possible to deal with a print mode that gives priority to the speed of printing, such as a high speed print mode.

(2) Furthermore, when in a print mode in which print quality is "standard" or "high image quality" and printing speed is not given priority, a paper feeding operation that is accompanied by the roller reset operation (second paper feeding operation) is performed. Thus, although the paper feeding operation needs to take a little bit longer time, but it is possible to always perform paper transport with a low torque. For this reason, it is possible to suppress heating of the stepping motor 52 to a lesser degree and also possible to always suppress a noise during paper transport to a lesser degree.

(3) When the paper transport operation is performed in such a manner that the counted value N of the counter 61 crosses the threshold value Na, which is the boundary between the A region and the B region, the paper transport is driven with a high torque. Thus, even when the paper feeding passes the boundary between the A region and the B region, it is possible to avoid the occurrence of a step-out of the stepping motor 52. For this reason, it is possible to avoid a deviation in printing position immediately after paper feeding has passed the boundary between the A region and the B region due to a step-out of the stepping motor 52 occurred during paper transport that has passed the boundary between the A region and the B region. For example, it is possible to prevent a decrease in printing image quality that a white line, or the like, appears on a printed image in the vicinity of a position corresponding to the boundary between the A region and the B region.

(4) When in the A region, by setting an electric current of the stepping motor 52 higher in a stop period between the adjacent paper transport operations (Hold period in FIG. 6), a high stop holding torque is ensured in comparison with the torque in the B region. Thus, even when the stepping motor 52, which is stopped after the paper transport has finished, receives an urging force that pushes back in the counter transport direction or an urging force that pushes out in the transport direction by the compression spring 21 of the hopper 15 or the spring of the paper return levers 25, it is possible to hold the sheet of paper P1, for which paper transport is performed, to an appropriate stop position. As a result, printing may be performed at an appropriate paper transporting position, and it is possible to prevent an image quality trouble, such as banding, that occurs due to a deviation of printing position in the auxiliary scanning direction.

(5) Because an electric current of the stepping motor 52 is set higher during paper transport movement (acceleration 1, acceleration 2, constant speed, deceleration 1, deceleration 2 in FIG. 6), it is possible to avoid the occurrence of a step-out of the stepping motor 52 during the paper transport movement. Thus, the paper transport operation may be reliably performed with a prescribed amount of paper transport, and printing may be performed at an appropriate paper transporting position, so that it is possible to prevent an image quality trouble, such as banding, that occurs due to a deviation of printing position in the auxiliary scanning direction.

(6) Because the high torque voltage value and acceleration/deceleration table, which is used when the sheet of paper P1 is in the A region (N<Na), is also used as a paper feeding table, it is unnecessary to separately provide the voltage value and acceleration/deceleration table for the A region (A mode) and for the paper feeding. In addition, when the high torque voltage value table is used for paper feeding, a voltage value (Vc3), which is higher than a voltage value (Vc2) that is applied during the other period in paper feeding movement, is set during a period of "acceleration 2" corresponding to a timing at which a relatively large load resistance is applied as the paper feed roller 22 initiates to contact the sheet of paper P on the hopper 15. Thus, when the high torque voltage value table VT2 is also used for paper feeding, it is possible to prevent a step-out of the stepping motor 52 while suppressing an electric current value as low as possible.

(7) Even with the same transported distance D, the set target speeds are different between the high torque acceleration/deceleration table T and the low torque acceleration/deceleration table T. Therefore, as the transporting position of the sheet of paper P1 is transferred from the A region to the B region, it switches from the high torque to the low torque and the transport speed (setting speed) also switches. Because the transport speed (setting speed) also switches in accordance with the torque, it becomes easy to adjust the acceleration/deceleration table so as to improve the accuracy of stop position when the paper transport operation is completed.

(8) It is judged whether the leading end setting position No exceeds the threshold value Na of the A region. When the leading end setting position exceeds the threshold value Na (N≧Na), and when the second paper feed sequence in which three processes, that is, the roller reset operation in the transport direction, the reverse feeding operation in the counter transport direction, and the leading end setting operation in the transport direction, is not performed, but the second paper feed sequence in which the first paper feeding operation is performed once in the transport direction only is employed, a redundant paper feeding operation may be omitted to improve the throughput of printing.

Note that it is not limited to the above described embodiments, but the following embodiments may be applicable.

Alternative Embodiment 1

In the embodiments, when print quality is "standard", it may be configured to perform the first paper feeding operation. In addition, when two or more choices of print conditions are present for determining a print mode, and when the choice that maximally gives priority to a printing speed among them is selected, it is only necessary to perform the first paper feeding operation. Of course, the items of print condition that affects the printing speed are not limited to the print quality, it may be printing resolution, paper type (medium type), or on/off of bidirectional printing. When the printing resolution is, for example, used among these, the first paper feeding operation is executed when the printing resolution is low. When the medium type is used, the first paper feeding operation is executed when plain paper, which may be used for tentative printing, is selected, for example. The first paper feeding operation is executed when the bidirectional printing is selected. Note that setting with the choice here may be performed in such a manner that a user makes selection on the setting screen of the display device 35*a* of the host computer 35 with the input device 35*b* or with the operating panel of the printer 11; however, it is not limited to this A configuration is also applicable in which, in accordance with the result selected among the choices of an item set by a user, the paper feed sequence is selected on the basis of a choice selected automatically by the printer.

Alternative Embodiment 2

In the above embodiments, a position, at which the return operation of the hopper 15 and the return operation of the paper return levers 25 both are completed, is used as a threshold value of the A region; however, another timing may be set as a threshold value of the A region. For example, when one of the load resulting from the return operation of the hopper 15 and the load resulting from the return operation of the paper return levers 25 is considerably small, that smaller load may be ignored and the threshold value of the A region may be set in conformity with the larger load. For example, the threshold value of the A region may be set to the timing at which the return operation of the hopper 15 is completed. Furthermore, a motor current value (command voltage value) applied to the stepping motor may be changed between a period during which the load resulting from the return operation of the hopper 15 and the load resulting from the return operation of the paper return levers 25 both are applied and a period during which one of the loads is applied. That is, the motor current value (command voltage value) is set large in a period during which both loads are applied, while, in a period during which one of the loads is applied, the motor current value (command voltage value) is set small in accordance with a proportion of that load. Moreover, when there is a specific period during which a particularly large load is applied within the return operation period, the threshold value of the A region may be set in conformity with the termination of that specific period. That is, the threshold value of the A region may be set in the midway of the return operation.

Alternative Embodiment 3

The loading factor in the automatic sheet feeder is not limited to at least one of the hopper 15 and the paper return levers 25. For example, the threshold value of the A region may be set using a retard member, such as the retard roller 24, as a mechanical load generating factor. In this case, even when the retard member is not coupled to the stepping motor for driving, a load is applied to the stepping motor during paper feeding when the retard member acts as a resistance against a sheet of paper being fed. Thus, it is possible to prevent a step-out of the stepping motor due to a load that is applied through such a sheet of paper. Furthermore, it is applicable that the paper feed roller 22 itself may be a mechanical load generating factor. For example, in a configuration in which the paper feed roller 12 pinches the rear portion of a sheet of paper even when the leading end setting is completed, the threshold value of the A region may be set in accordance with a paper position at the time when the pinching of the paper feed roller 22 is released. In addition, it is not limited to the automatic sheet feeder, but, when the loading factor is present in a manual sheet feeder, the threshold value of the A region may be set in accordance with a paper position at which the loading factor disappears.

Alternative Embodiment 4

In the above embodiments, for example, in the transport operation, a torque in the acceleration region may be set high, a torque in the constant speed region may be set high, or a torque in the deceleration region may be set high. Furthermore, when transport operation is performed in an intermittent manner, it may be set to a torque higher than a stop torque only that is applied during a stop period between the adjacent transport operations.

Alternative Embodiment 5

In the above embodiments, the compression spring 21 of the hopper 15 and the spring of the paper return levers 25 both urge the stepping motor in the transport direction or in the counter transport direction, but it is unnecessary to be urged by the spring. For example, it is applicable without spring. Even without spring, when a load for returning the hopper 15 and the paper return levers 25, which are movable members, is applied through the cam mechanism, a step-out of the stepping motor may possibly occur during paper transport. Thus, by employing the invention, it is possible to avoid the occurrence of a step-out of the stepping motor while a medium is being transported. Moreover, the movable members, such as the hopper 15, that constitute the feeding device may be urged in a direction in which an urging force in the paper transport direction is applied to the stepping motor. In this case, it is possible to prevent a step-out of the stepping motor, in which a sheet of paper that has once stopped by being fed is further pushed out in the paper transport direct on.

Alternative Embodiment 6

In the above embodiments, whether it is in a predetermined operation period is judged by judging whether $N<Na$ is satisfied on the basis of the counted value of the counter 61, which indicates a transporting position of a sheet of paper, which serves as a medium; however, another judging method may be employed. For example, it may employ a method in which a rotational position of the paper feed roller 22 is detected by a sensor or an encoder, and then it is judged whether the detected rotational position is located at a position corresponding to the predetermined operation period of the ASF 13, which serves as a feeding device. In short, as long as it can judge whether the ASF 13 is in the predetermined operation period, any method may be employed.

Alternative Embodiment 7

In the above embodiments, the stepping motor, which is a step drive driving source, is not limited to a rotary motor. For example, a linear stepping motor may be employed. In addition, it is unnecessary that the paper feed roller 22 is a D-shaped roller in side view. It may be applied to a printer that uses a cylindrical roller.

Alternative Embodiment 8

In the above embodiments, the paper feed and paper transport processes (including the paper feed sequence and the paper transport sequence) are implemented by software in such a manner that the CPU 43 executes programs; however, it is not limited to a method through software. For example, the paper feed and paper transport processes may be implemented by hardware using a control circuit (custom IC, or the like). Furthermore, the paper feed and paper transport processes may be implemented by a combination of hardware and software.

Alternative Embodiment 9

It is not limited to the ink jet printer. It may be applied to other serial printers, such as a dot impact printer.

Alternative Embodiment 10

In the above embodiments, the image forming apparatus is embodied as the ink jet serial printer; however, the ink jet image forming apparatus of this type that ejects liquid is not limited to a liquid ejecting apparatus that prints an image by ejecting ink droplets, but it may be applied to other liquid ejecting apparatuses. It may also be embodied as a liquid ejecting apparatus that ejects liquid (including a fluid body in which particles of a functional material are dispersed) other than ink. For example, it may be a liquid ejecting apparatus that ejects a fluid body containing dispersed or dissolved material, such as electrode material or color material, used for manufacturing a liquid crystal display, an EL (electroluminescence) display, a field emission display, or the like. In this case, an image, such as a pixel pattern or a wiring pattern, is formed through drawing by ejecting liquid droplets onto a substrate as a medium. For example, when sheet-like substrates are sequentially fed one by one by an automatic sheet feeder and an image, such as a wiring pattern, is drawn on the fed substrate through a liquid ejecting method by a recording means, it is possible to improve the accuracy of position of the substrate, which serves as a medium, and also possible to form an image, such as a wiring pattern, with high positional accuracy.

Hereinafter, the technical ideas that may be understood from the above embodiments and alternative embodiments will be described.

(1) The image forming apparatus according to any one of Claims 1 to 6, wherein the feeding device includes an urging means (21) that urges a movable portion (15, 25) in a direction in which an urging force in a transport direction or counter transport direction of a medium is applied to the driving source.

(2) The image forming apparatus according to Claim 2, wherein the control means, to which a transporting acceleration/deceleration table that is set to control a speed of the driving source when making the transport device perform a transport operation and a feeding acceleration/deceleration table that is set to control driving of the driving source when making the feeding device perform a feeding operation and that is set with a torque higher than that of the transporting acceleration/deceleration table, selects the feeding acceleration/deceleration table when a transporting position of the medium is in the setting region. According to this, because, when a high torque is set, the feeding acceleration/deceleration table that is set with a torque higher than that of the transporting acceleration/deceleration table is used, it is unnecessary to provide an additional acceleration/deceleration table for setting a high torque in a transport process.

What is claimed is:

1. An image forming apparatus comprising:

a feeding device that feeds a medium during a loading period;

a transport device that transports the medium fed by the feeding device;

an image recorder that forms an image on the medium transported by the transport device;

a step drive driving source that drives both the feeding device and the transport device;

a position detector that detects a transporting position of the medium;

a judging means that determines whether the feeding device is in the loading period during which the operation of the feeding device applies a load to the driving source by determining whether the transporting position of the medium detected by the position detector falls within a region;

a recording mode setter that sets a recording mode; and a controller that sets a torque of the driving source, wherein the controller selectively operates in a first recording mode and in a second recording mode, wherein in the first recording mode:

a first feeding operation is performed wherein a leading end setting position of the medium is set by transporting the medium only the transport direction, and wherein when operating in the first recording mode, the controller sets a first torque when the judging means determines that the feeding device is the loading period in order to offset the load applied on the driving source during the loading period, wherein after the controller continues to apply the first torque when the step driving source is driving the transport device regardless of whether the step driving source is also driving the feeding device if the judging means determines that the feeding device is in the loading period, and wherein the controller sets a second torque, which is less than the first torque when the judging means determines that the loading period is complete, and wherein in the second recording mode:

a second feeding operation is performed wherein a reverse feeding operation is performed on the medium after the medium is fed in the transport direction to a position at which the loading period of the feeding device ends, wherein in the reverse feeding operation the medium is fed in the counter transport direction in order to set the medium to a leading end setting position, and wherein the controller sets the driving source with the second torque irrespective of the load is applied to the driving source.

2. The image forming apparatus according to claim 1, wherein the feeding device includes a feed roller and a pivotable lever that moves from a waiting position to a feedable position in cooperation with initiation of the feed roller when the feeding device is driven by the step driving source and feeding is started and that returns to the waiting position when feeding is completed and the feeding device ceases to be driven by the step driving source, wherein the loading period is a period during which a return operation of the lever to the feedable position is performed.

3. The image forming apparatus according to claim 1, wherein the controller sets a stop torque of the driving source, during a stop period between adjacent transport operations wherein two transport operations are performed sequentially, such that the stop torque is higher in the loading period than the torque of the driving source in the period after the loading period has passed.

4. The image forming apparatus according to claim 1, wherein the controller sets the first torque during the loading period and an intermediary period prior to the period after the loading period has passed when a transport operation is initiated.

* * * * *